US007445559B2

(12) United States Patent
Kakuda

(10) Patent No.: US 7,445,559 B2
(45) Date of Patent: Nov. 4, 2008

(54) SWING WITH SUPPORT BASE

(75) Inventor: Baku Kakuda, Reading, PA (US)

(73) Assignee: Graco Children's Products Inc., Exton, PA (US)

( * ) Notice: Subject to any disclaimer, the term of this patent is extended or adjusted under 35 U.S.C. 154(b) by 0 days.

(21) Appl. No.: 11/080,670

(22) Filed: Mar. 16, 2005

(65) Prior Publication Data

US 2006/0211506 A1 Sep. 21, 2006

(51) Int. Cl.
*A63G 9/12* (2006.01)

(52) U.S. Cl. ..... 472/118; 472/119; 297/273; 5/93.1

(58) Field of Classification Search ..... 472/118, 472/119, 125; 297/273, 277, 278; 5/108, 5/109, 102, 93.1, 93.2, 99.1
See application file for complete search history.

(56) References Cited

U.S. PATENT DOCUMENTS 4,805,902 A * 2/1989 Casagrande ..... 472/119
5,525,113 A * 6/1996 Mitchell et al. ..... 472/119
5,562,548 A * 10/1996 Pinch et al. ..... 472/119
5,803,817 A 9/1998 Stern
5,961,180 A 10/1999 Greger et al.
6,027,163 A 2/2000 Longenecker
6,027,409 A 2/2000 Favorito et al.
6,386,986 B1 5/2002 Sonner et al.
6,520,862 B1 * 2/2003 Armbruster et al. ..... 472/118
6,626,766 B1 * 9/2003 Hsia ..... 472/119
6,645,080 B1 11/2003 Greger et al.
6,692,073 B1 * 2/2004 Weathersby ..... 297/256.16
6,728,980 B1 * 5/2004 Chen ..... 5/93.1
2004/0198512 A1 10/2004 Ransil et al.
2005/0014569 A1 1/2005 Greger et al.
2005/0059502 A1 3/2005 Greger et al.

OTHER PUBLICATIONS

Edu-play advertisement, Kuku Toys Co., Ltd., 2 pp.
Photographs (3) of Graco Children's Products Inc. Snugride car seat with base.
Photographs (2) of Graco Children's products Inc. Snugrider stroller frame.
Photographs (2) of Baby Trend Snap and Go stroller frame.
Photograph (1) of Graco Children's Products Inc., cradle swing.
Photograph (1) of Fisher-Price 3 in 1 cradle swing.

* cited by examiner

*Primary Examiner*—Kien Nguyen
(74) *Attorney, Agent, or Firm*—Lempia Braidwood LLC

(57) ABSTRACT

A child swing includes a frame, a hanger arm movably coupled to the frame, and a support base coupled to the at least one hanger arm. The support base is configured to hold a child carrier of an infant car seat and to enable removal of the child carrier. The support base has two or more attachment locations at which the child carrier can be attached to the support base. Upon removal of the child carrier from the support base, the support base remains coupled to the hanger arm, and the hanger arm remains coupled to the frame. The support base can also enable removal of the child carrier from the support base via actuation of a release latch of the child carrier, and the support base is movably coupled to the hanger arms to move between an in-use position and a fold position.

22 Claims, 24 Drawing Sheets

SWING WITH SUPPORT BASE

FIELD OF THE INVENTION

The invention relates to a swing. More specifically, the invention relates to a child swing with a support base for receiving a child carrier of an infant car seat.

BACKGROUND OF THE INVENTION

Various types of child swings are known in the art. Typically, swings include a support frame, hanger arms pivotally attached to the support frame, and a swing seat attached to the hanger arms. Electrically powered drive mechanisms can be utilized to supply energy to the swing to move the swing seat in a reciprocal motion back and forth. Most swings include a permanently attached swing seat for holding a child in the swing.

Infant car seats typically include a base and an infant carrier that can attach to and be detached from the base. The base can remain in the vehicle, secured to the vehicle seat by a latch system or by the vehicle belt system, and the infant carrier can be removed from the base to transport the child. Infant car seats in the market today are popular because of the convenience they offer to caregivers. Children tend to fall asleep when in a vehicle due to the rocking motion. The infant carrier allows a caregiver to carry a sleeping child from vehicle to home or other destination without disturbing the child. Unfortunately, when the caregiver places the infant carrier on the floor or other support surface, and the rocking motion stops, the child often will wake up.

Thus, there is a need for a child swing that can receive a child carrier of an infant car seat so that a child sleeping in the child carrier will continue to experience a soothing, rocking motion outside the vehicle.

SUMMARY OF THE INVENTION

An aspect of the present invention relates to a child swing that includes a frame, at least one hanger arm movably coupled to the frame, and a support base coupled to the at least one hanger arm. The support base is configured to hold a child carrier and to enable removal of the child carrier. The support base has two or more attachment locations at which the child carrier can be attached to the support base. Upon removal of the child carrier from the support base, the support base remains coupled to the at least one hanger arm, and the at least one hanger arm remains coupled to the frame.

Another aspect of the present invention relates to a child swing that includes a frame, at least one hanger arm movably coupled to the frame, a support base coupled to the hanger arm, and a child carrier having a child seating area and a release latch. The support base is adapted to receive the child carrier and to enable removal of the child carrier from the support base via actuation of the release latch of the child carrier.

A further aspect of the invention relates to a child swing that comprises a frame foldable between an in-use configuration and a fold configuration, at least one hanger arm movably coupled to the frame, and a support base configured to receive a child carrier of an infant car seat. The support base is movably coupled to the at least one hanger arm to move between an in-use position and a fold position. Upon removal of the child carrier from the support base, the support base remains coupled to the at least one hanger arm, and the at least one hanger arm remains coupled to the frame.

A further aspect of the present invention relates to a child swing that includes a frame, at least one hanger arm movably coupled to the frame, a support base coupled to the at least one hanger arm, and a child carrier removably coupled to the support base and configured to removably couple to a base of an infant car seat.

It is to be understood that both the foregoing general description and the following detailed description are exemplary and explanatory only and are not restrictive of the invention as claimed.

BRIEF DESCRIPTION OF THE DRAWINGS

The accompanying drawings, which are incorporated in and constitute a part of this specification, illustrate several embodiments of the invention and, together with the description, serve to explain the principles of the invention.

FIGS. 6A-6C are detail perspective views of the components of a recline and/or fold assembly, in which FIG. 6A is an assembled view and FIGS. 6B and 6C are partially exploded views.

DETAILED DESCRIPTION

Reference will now be made in detail to embodiments of the invention, examples of which are illustrated in the accompanying drawings. An effort has been made to use the same reference numbers throughout the drawings to refer to the same or like parts.

Figure 2:
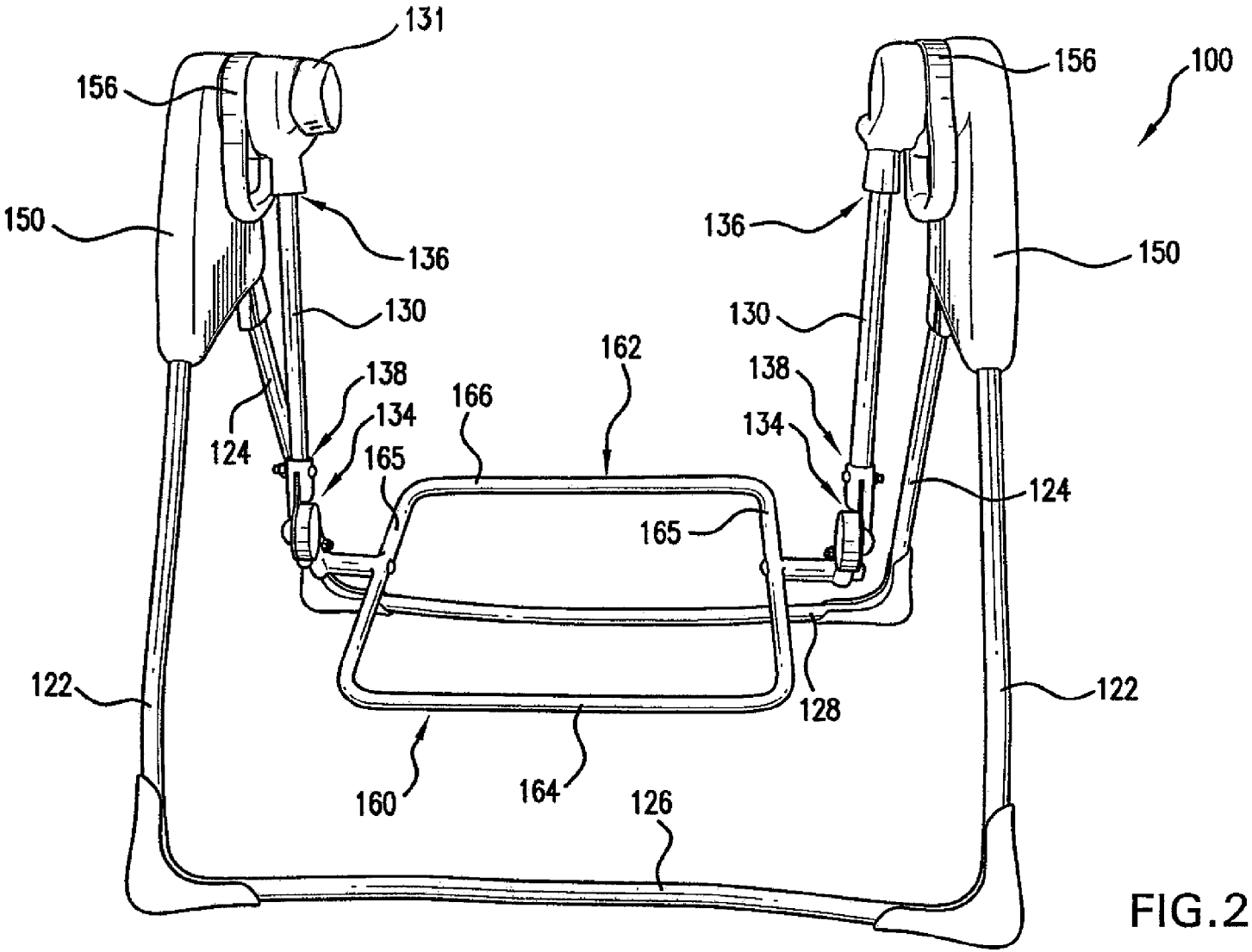
FIG. 2 is a front perspective view of the swing of FIG. 1.
Figure 13:
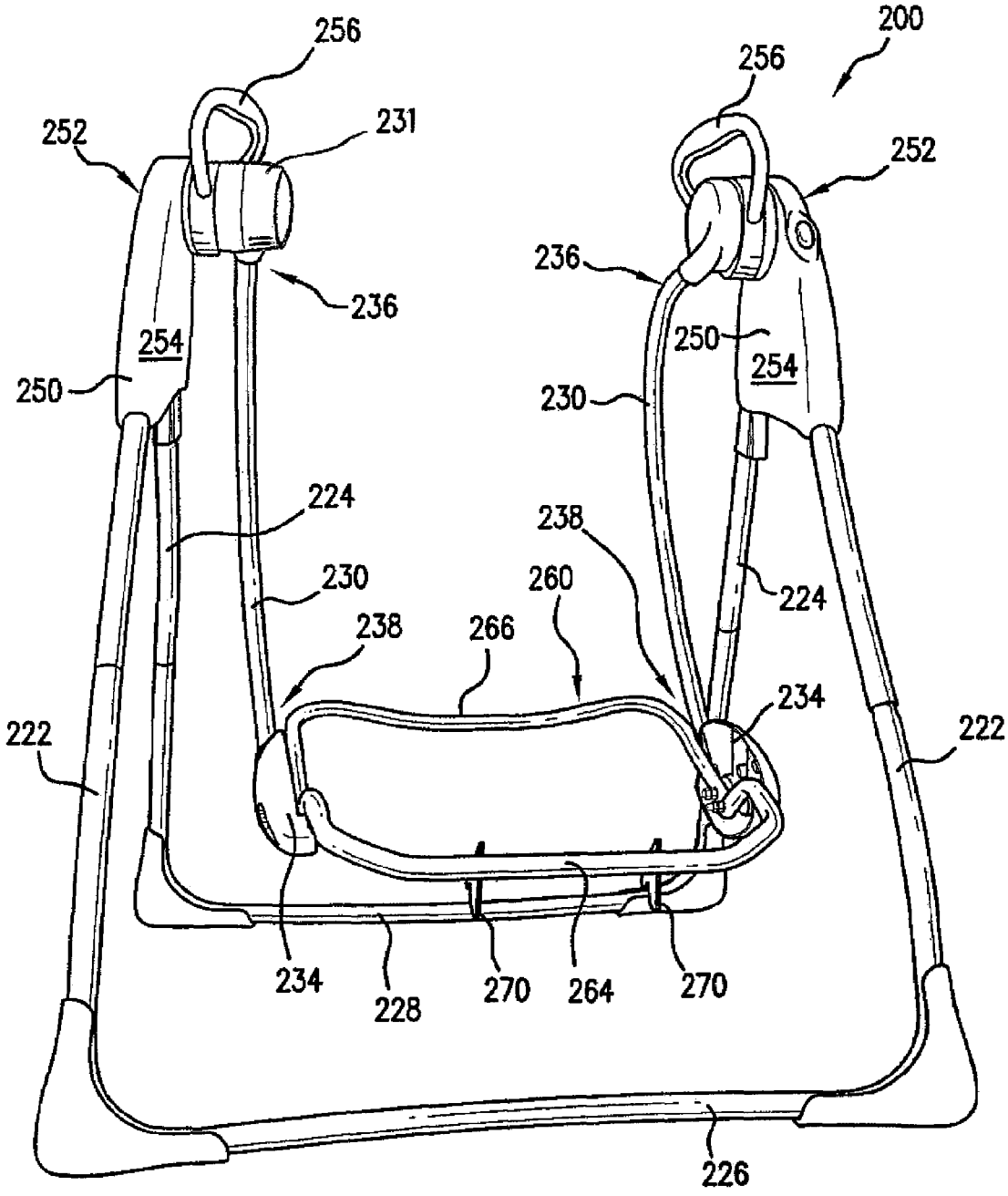
FIG. 13 is a front perspective view of a swing according to another embodiment of the invention.
Figure 14:
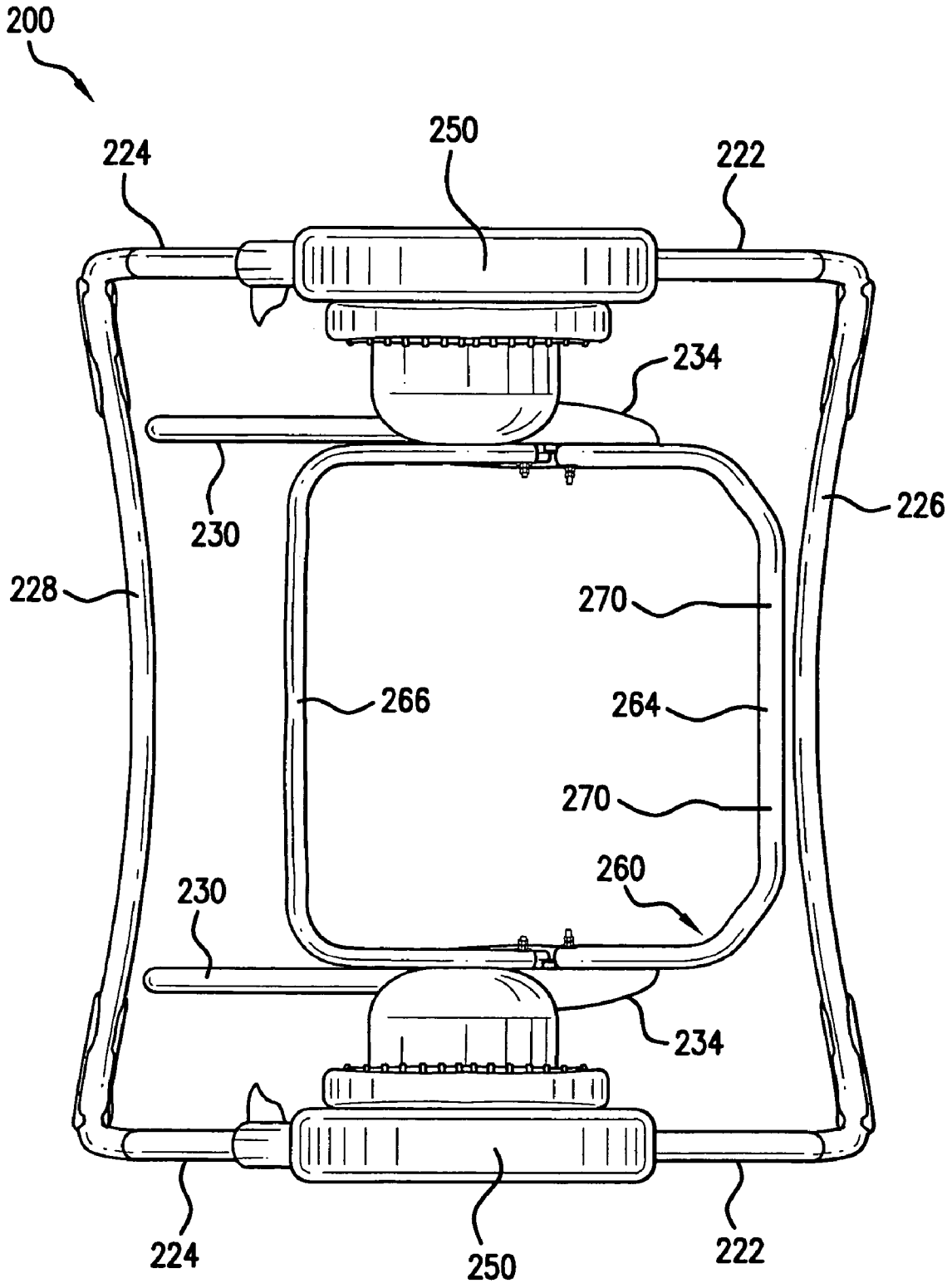
FIG. 14 is a top plan view of the swing of FIG. 13.

The swing of the invention includes a support base, for example support base 160 in FIG. 2 or support base 260 in FIG. 13, that is configured to receive and hold a child carrier 110, such as a child carrier of an infant car seat, and to enable removal of the child carrier 110. Child carriers in the market today are popular because of the convenience they offer to caregivers. Children tend to fall asleep in vehicles in their infant carriers due to the motion of the vehicle. The infant carrier allows a caregiver to carry a sleeping child from vehicle to home or other destination without disturbing the child. The support base of the swing is designed so that a caregiver can carry a child sleeping in a child carrier from the vehicle to the swing, place the child carrier on the support base of the swing, and turn on the swing so that the sleeping child can continue to experience soothing motion. The support base can be adjustable to accommodate a variety of child carriers. The support base also may recline or may fold to a storage position. Further, the swing has a simple construction and is easy to set-up. Coupling a child carrier to the swing and later removing the child carrier is enabled by the simple construction of the swing. Upon removal of the child carrier from the support base, the support base remains coupled to the hanger arm and the hanger arm remains coupled to the frame.

It is contemplated that the support base 160, 260 of this invention can be coupled to many different types of swing frames, including full size, compact, and travel swing frames, swing frames with differently shaped swing frame legs, swing frames with differently shaped hanger arms, and swing frames with only a single hanger arm.

FIGS. 1-4 illustrates a child swing 100 according to an embodiment of the invention. The swing 100 includes a frame 120, first and second hanger arms 130 movably coupled to the frame 120, and a support base 160 coupled to first and second hanger arms 130. The support base 160 is configured to hold a child carrier 110 of an infant car seat and to enable removal of the child carrier 110.

The frame 120 of the illustrated embodiment includes first and second front legs 122, first and second rear legs 124, housings 150 to which the front and rear legs 122, 124 are coupled, a front cross member 126 extending between the front legs 122, and a rear cross member 128 extending between the rear legs 124. In other embodiments, the frame 120 can include first and second front legs only or first and second rear legs only. The housings 150 have an outboard side 152 and an inboard side 154 facing the support base 160. Additionally, the frame 120 can include handles 156 positioned on the outboard 152 or inboard 154 side of the housing 150. The handles 156 allow a user to easily pick up and move the swing 100. Further, the handles 160, may be movable, such as disclosed in U.S. application Ser. No. 10/804,184, filed Mar. 19, 2004, which is incorporated by reference herein in its entirety.

The frame 120 is an open top frame such that when the child carrier 110 is coupled to the support base 160, an area above the child carrier 110 is free from obstruction by the frame 120. This area is open so that a child and the child carrier 110 can easily be installed in or removed from the support base 160 by a user. It is to be understood that a mobile or toy bar or similar device that can be attached to and removed from an open top swing are not to be considered to change an open top swing to a closed top swing.

Figure 1:
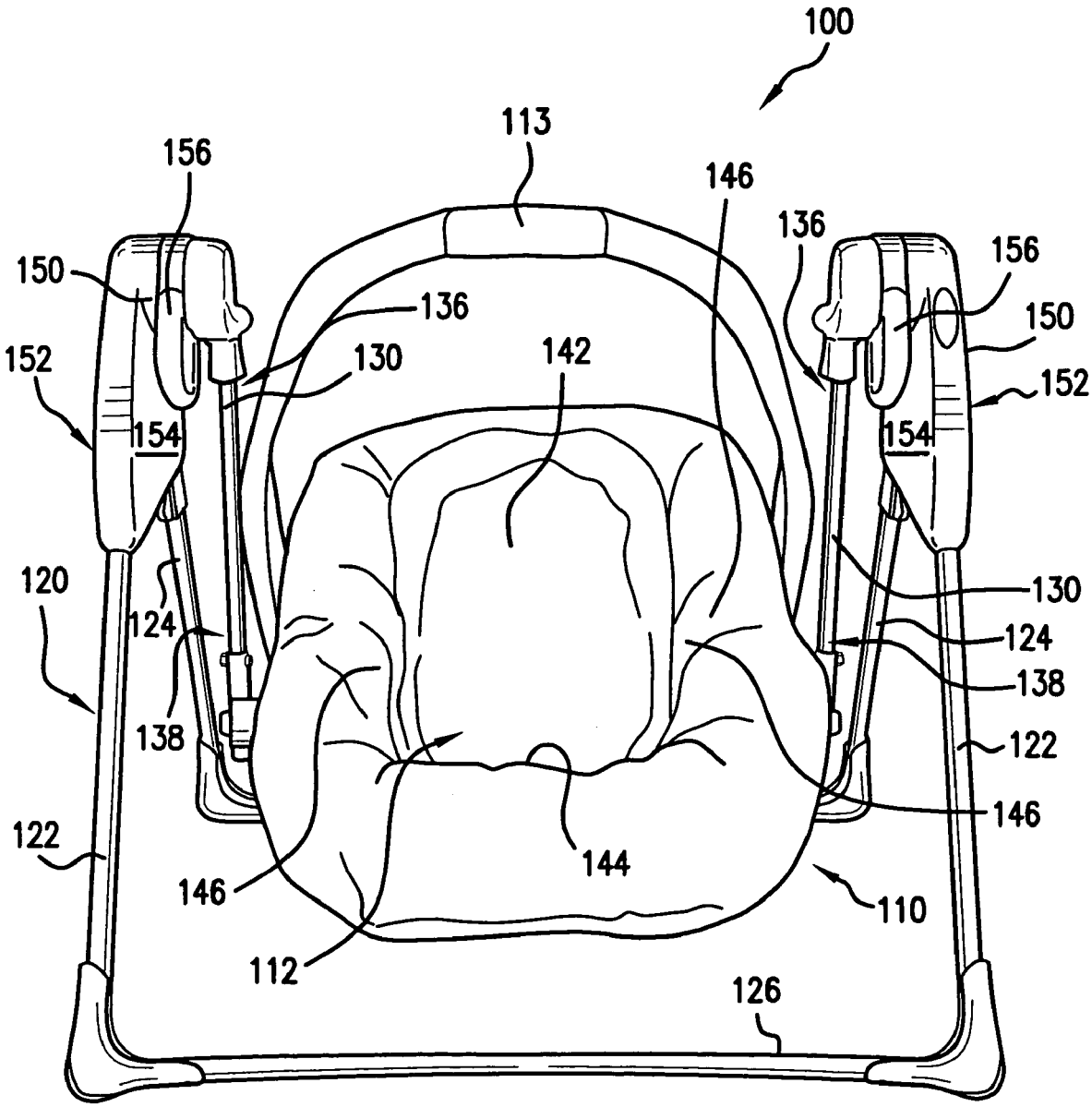
FIG. 1 is a front perspective view of a swing, showing a child carrier attached to a support base of the swing, according to an embodiment of the invention.
Figure 9:
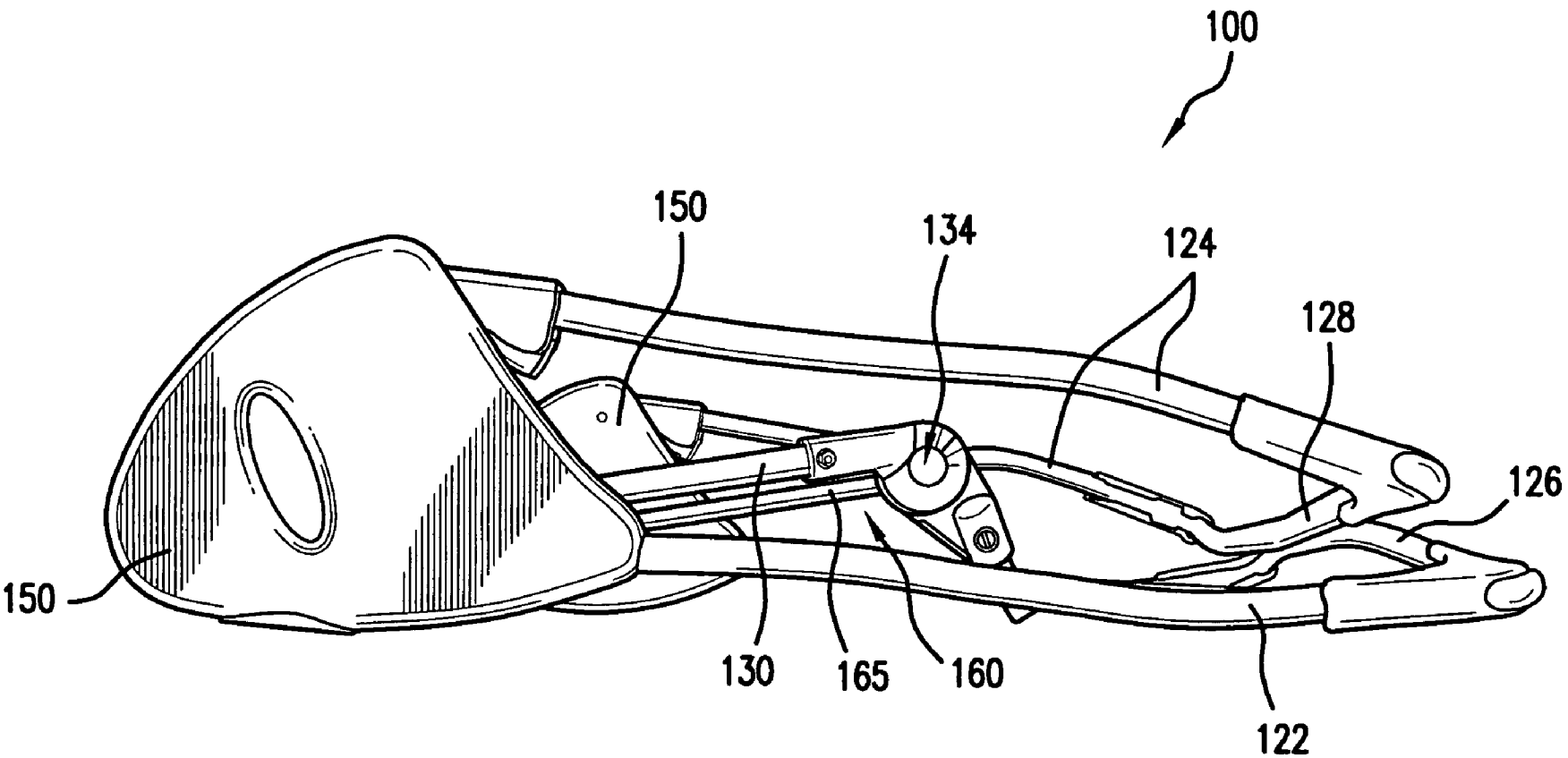
FIG. 9 is a side view of the swing of FIG. 1 showing the swing in a folded position.

Additionally, the frame 120 optionally can be configured to fold between an in-use configuration, as shown in FIG. 1, and a fold configuration, as shown in FIG. 9. For example, the front legs 122 and the rear legs 124 can be assembled so as to pivot relative to each other within the respective housings 150, such as disclosed in U.S. Pat. No. 6,645,080, issued Nov. 11, 2003, and U.S. Publication No. 20040198512, published Oct. 7, 2004, both of which are incorporated by reference herein in their entirety. A user can fold the frame 120, for example, by moving the rear legs 124 toward the front legs 122.

The frame 120 can also include a motor 131 as shown in FIG. 2 to swing the hanger arms 130, support base 160 and the child carrier 110. The motor 131 is configured to swing the weight of the child and the weight of the child carrier.

As mentioned above, the support base 160 is suspended from the frame 110 by the first and second arms 130 and is configured to receive a child carrier 110 of an infant car seat. The hanger arms 130 are movably coupled to the frame 120. For example, the hanger arms 130 can swing or pivot. A first end 136 of each hanger arm 130 can be attached to the frame 120 at the inboard side 152 of the respective housing 150. A second end 138 of each hanger arm 130 attaches to the support base 160 at a mount 134. The mounts 134 connect the hanger arms 130 to the support base 160. Alternatively, a single hanger arm 130 can also be used to suspend the support base 160.

Figure 3:
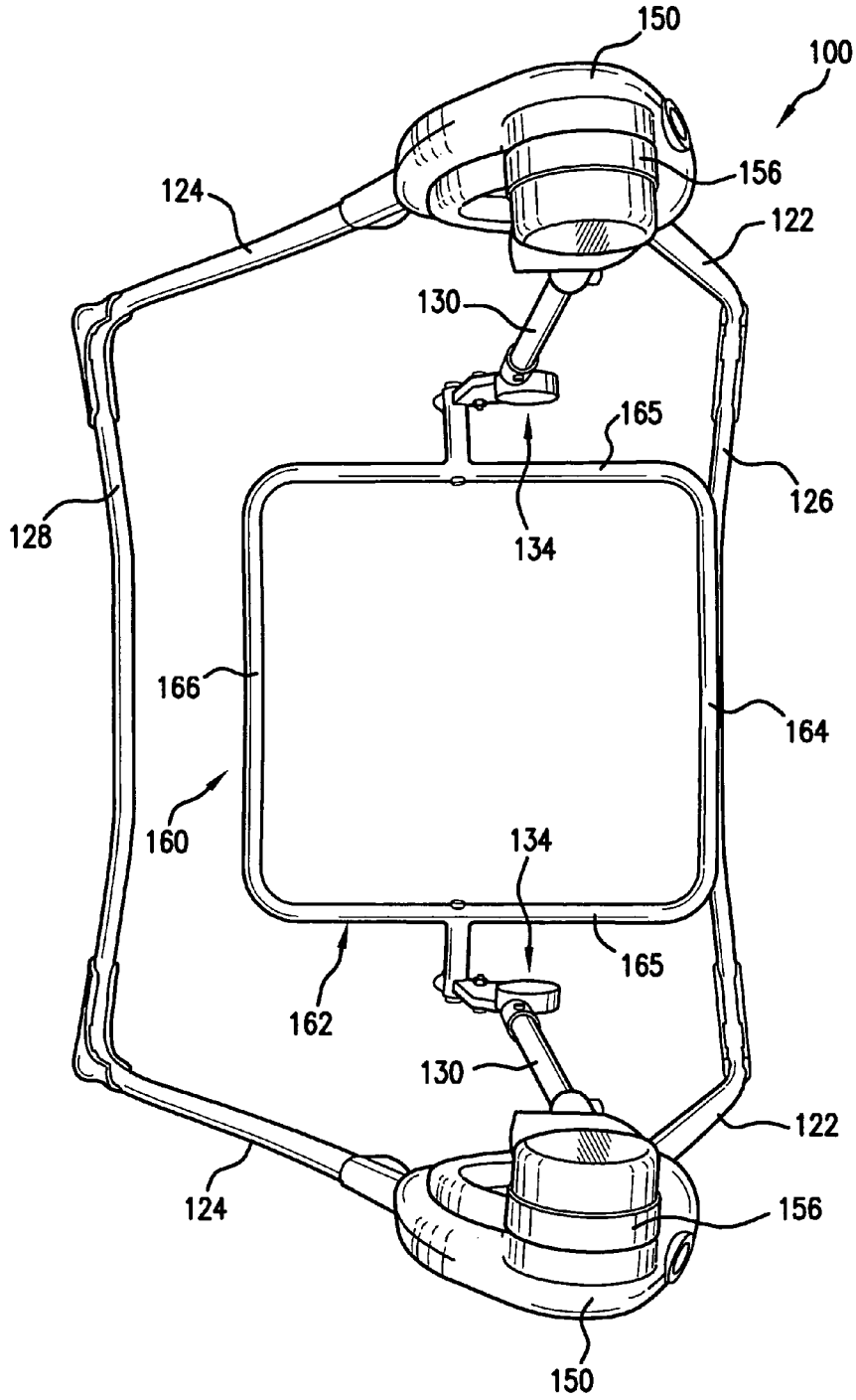
FIG. 3 is a top perspective view of the swing of FIG. 1.

The support base 160 includes a frame member 162. The frame member 162 can be formed in a continuous, rectangular shape, as seen in FIGS. 2 and 3, or in any other suitable shape. The frame member 162 can include a first frame member 164, a second frame member 166 opposite the first frame member 164, and side frame members 165. The frame members 164, 166 are mirror images of each other in the illustrated embodiment; it will be understood, however, that the frame members need not be identical in shape. The frame members 164, 166 need only be configured to securely and stably support the child carrier 110. The support base 160 includes two or more attachment locations at which the child carrier 110 can be attached to the support base. For example, the child carrier 110 can attach to the support base 160 at the first frame member 164, serving as a first attachment location, and the second frame member 166, serving as a second attachment location. The first frame member 164, which is closer to a front of the swing 100, can receive the "foot end" of the child carrier 110, and the second frame member 166, which is closer to a rear of the swing 100, can receive the "head end" of the child carrier 110. The support base 160 can be made of metal, or any other suitable material.

Figure 4:
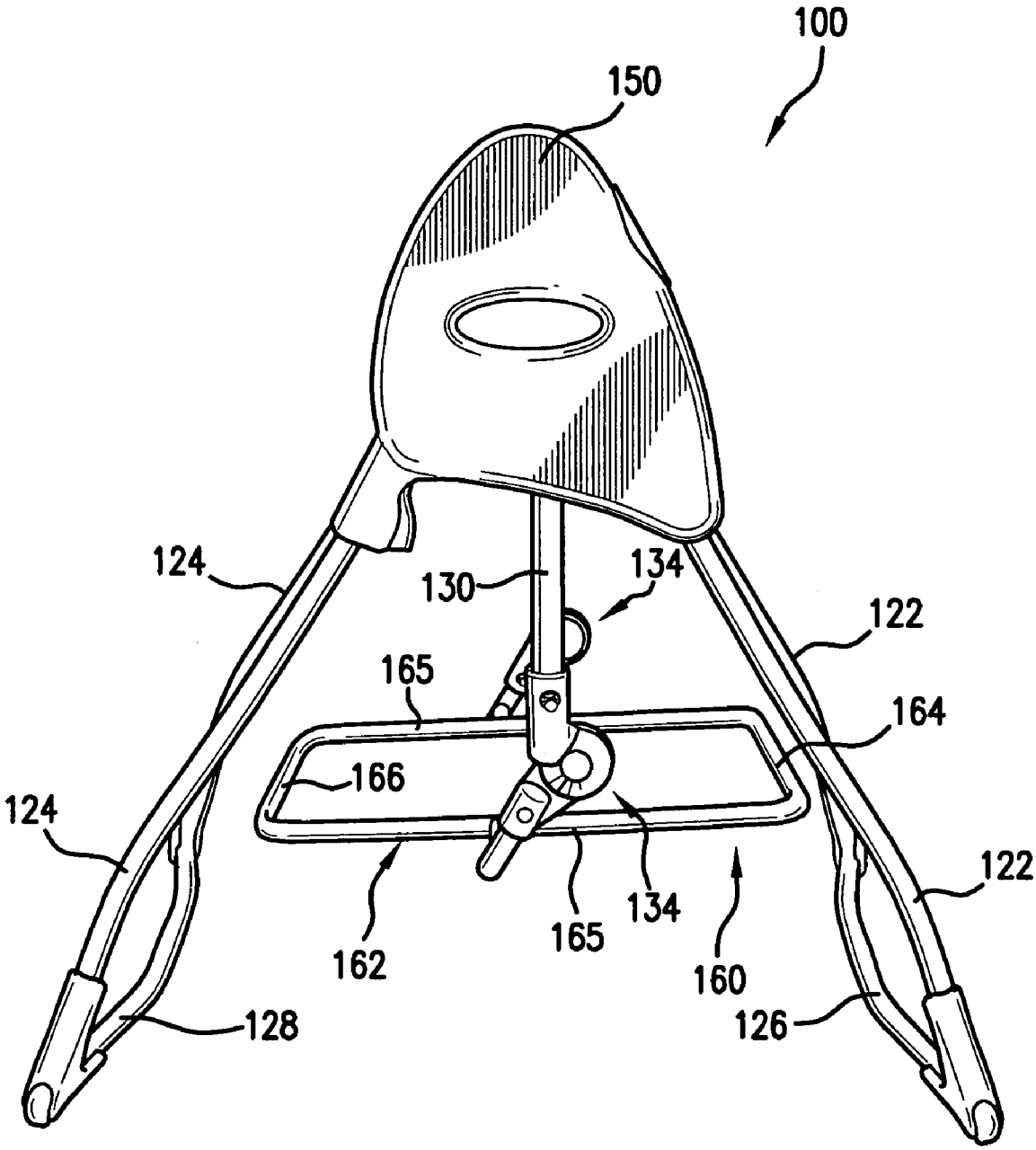
FIG. 4 is a side perspective view of the swing of FIG. 1.
Figure 5:
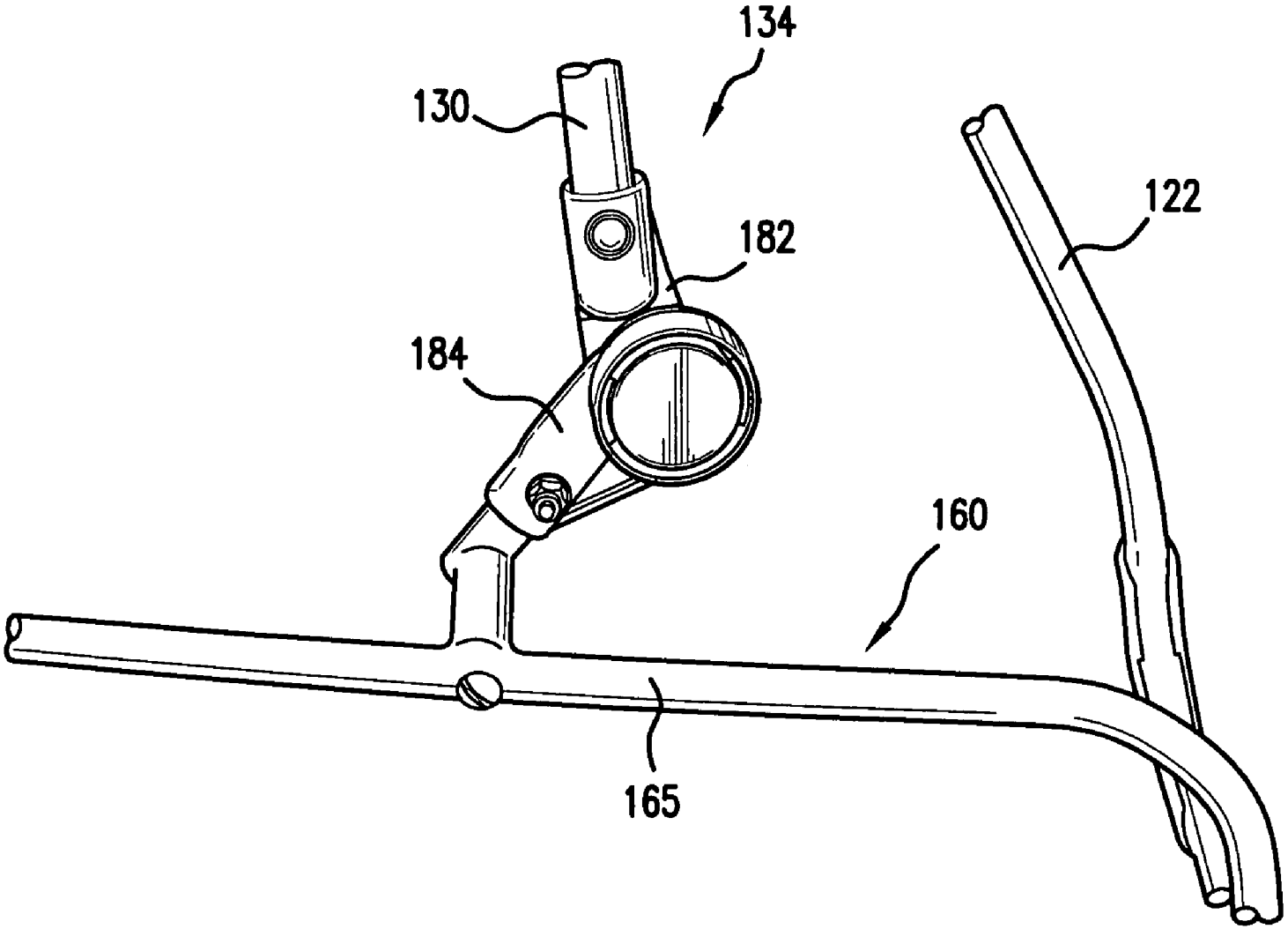
FIG. 5 is a detail, perspective view showing the connection between the hanger arm and the support base of the swing of FIG. 1.
Figure 7:
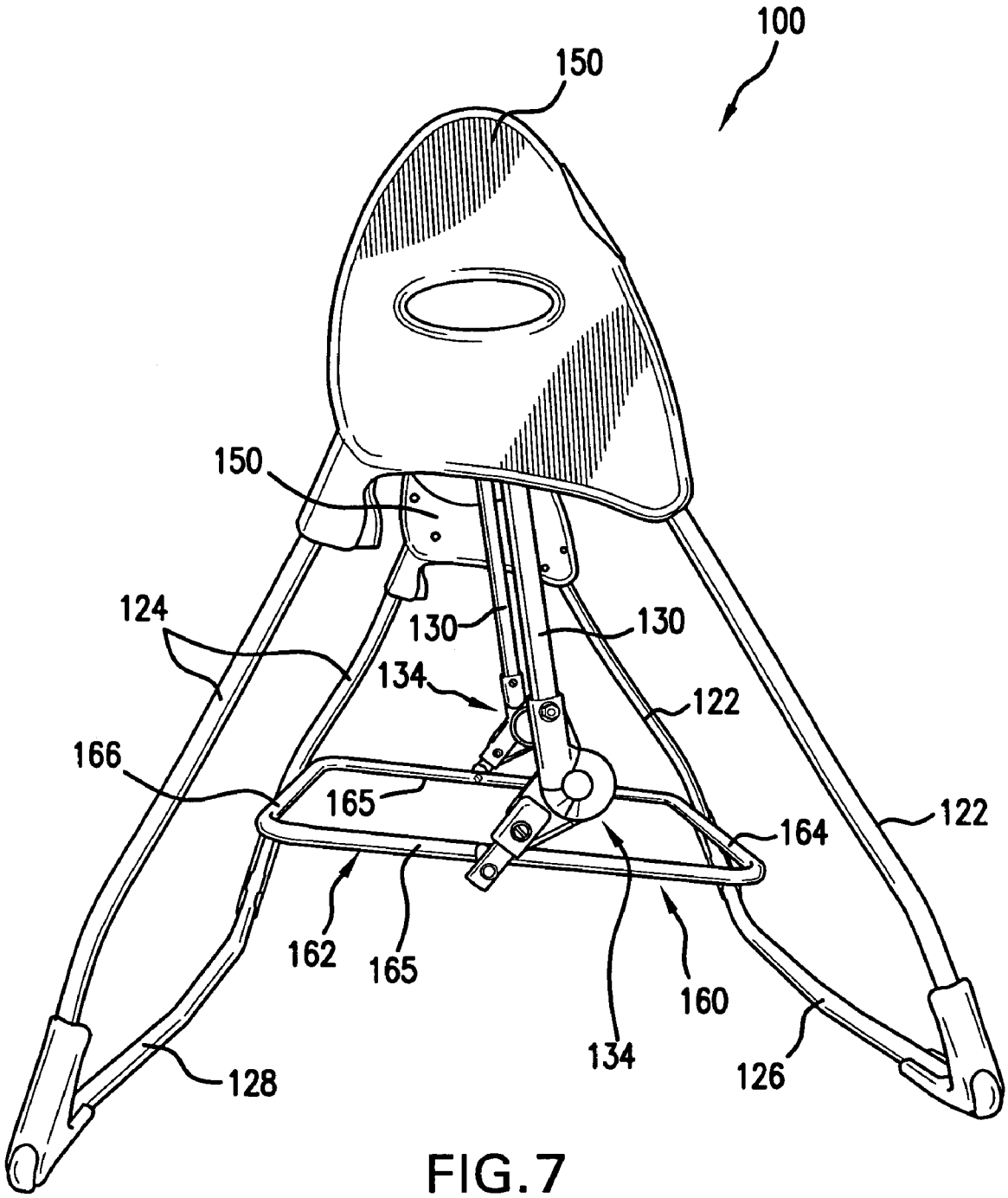
FIG. 7 is a side perspective view of the swing of FIG. 1 showing the support base in one recline position.

The support base 160 can be movably coupled to the hanger arms 130 by mounts 134. For example, the support base 160 can be movably coupled to the hanger arms 130 to move between a first recline position, as shown in FIG. 4, and a second recline position, as shown in FIG. 7, relative to the hanger arm 30. In one embodiment, the support base 160 can be pivotally coupled to the hanger arms 130 by respective pivot joints located at the mounts 134.

Figure 8:
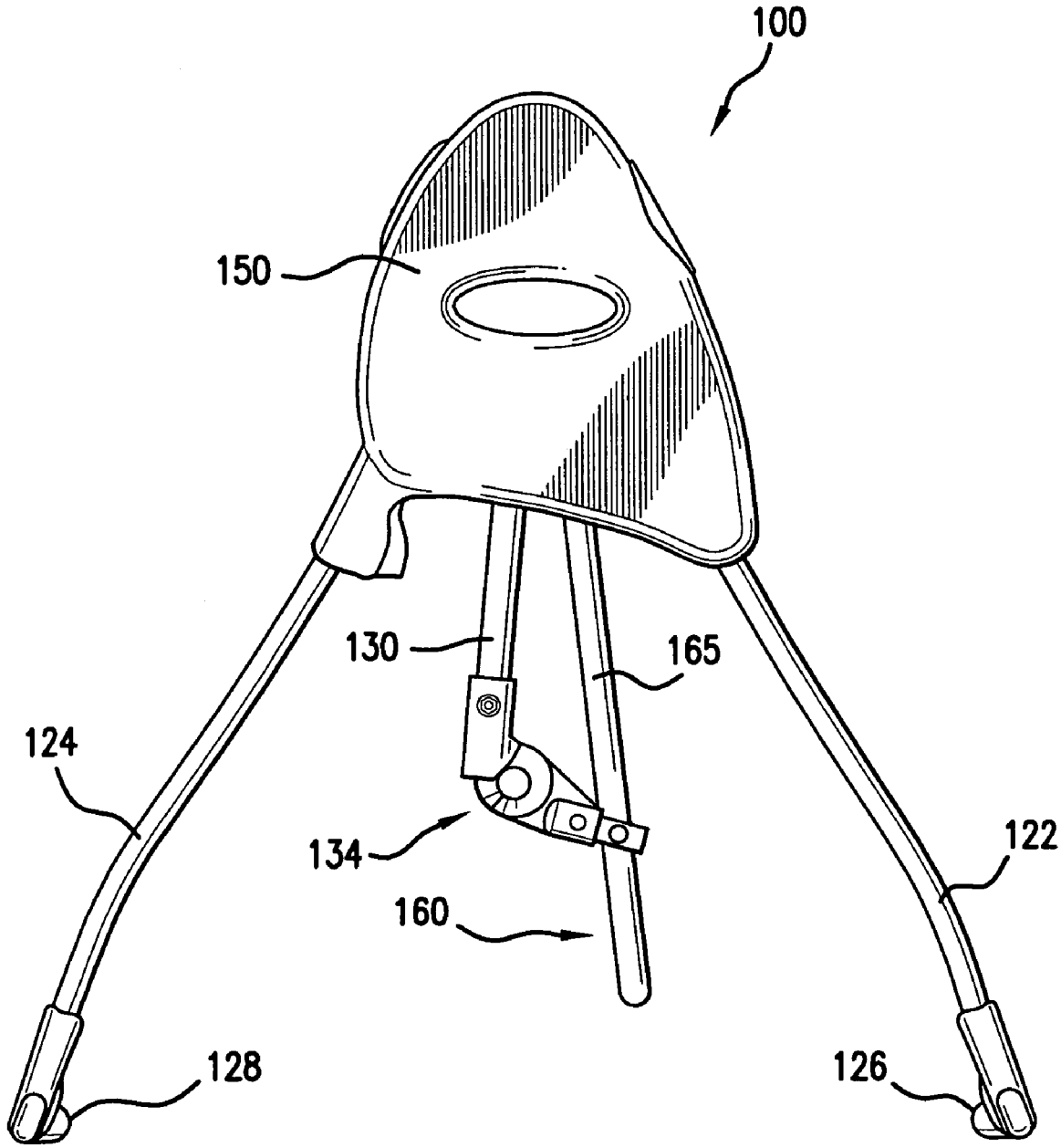
FIG. 8 is a side elevation view of the swing of FIG. 1 showing the support base folded to a storage position.

In addition, the support base 160 can be movably coupled to the hanger arms 130 by mounts 134 to move between an in-use position and a fold position. An exemplary in-use position is shown in FIG. 4 and an exemplary fold position is shown in FIG. 8. The support base 160 can be pivotally coupled to the hanger arms 130 by respective pivot joints located at the mounts 134. When the support base 160 is in the fold position, the support base 160 can be oriented substantially perpendicular to the surface upon which the swing 100 rests. If the swing frame 110 can be moved to a fold configuration, the support base 160 can be nested between the front and rear legs 122, 124 of the folded frame 120 to provide a compact fold for storage or transport, as shown in FIG. 9.

Figure 6A:
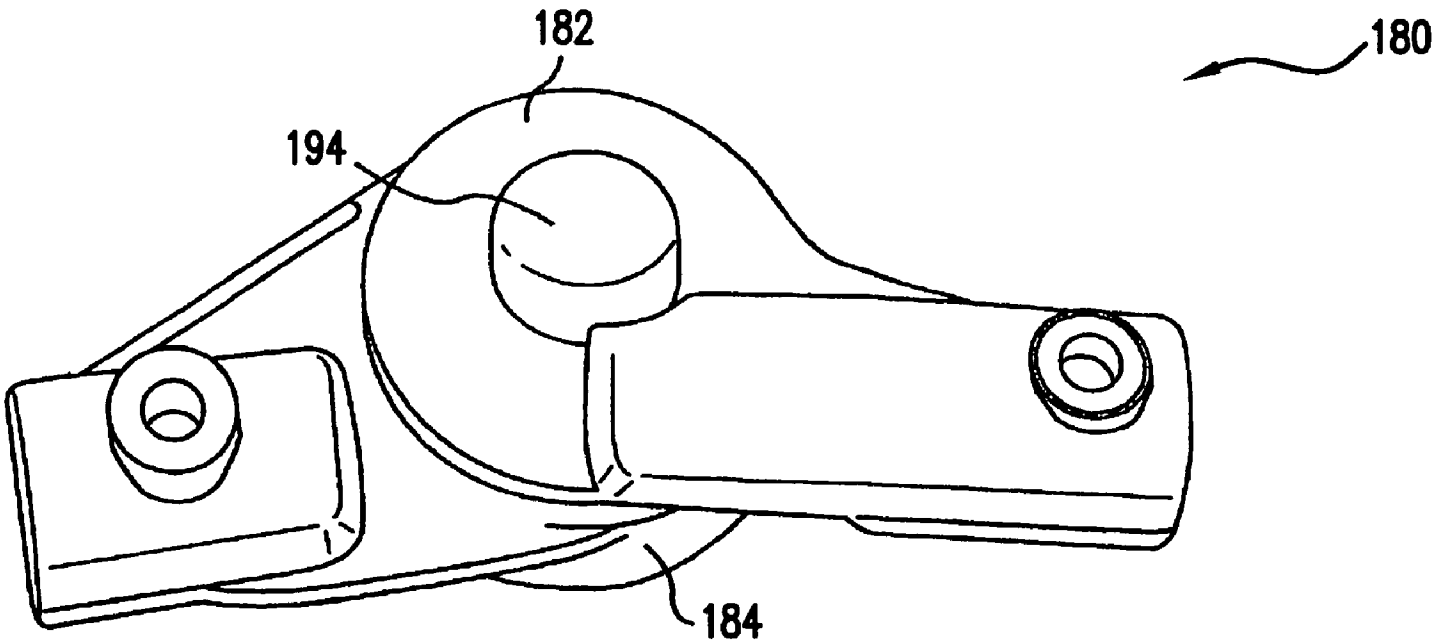
Figure 6B:
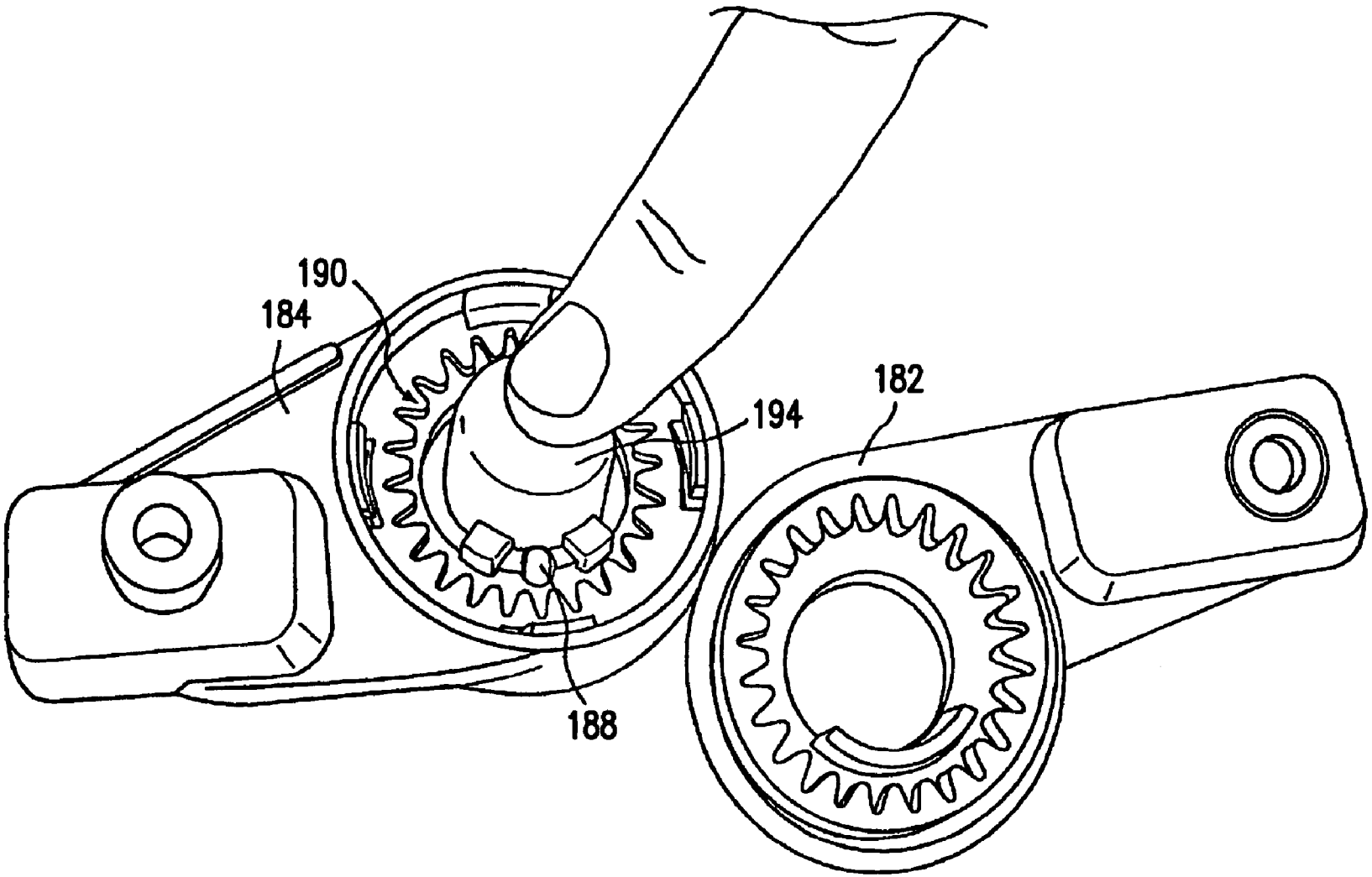
Figure 6C:
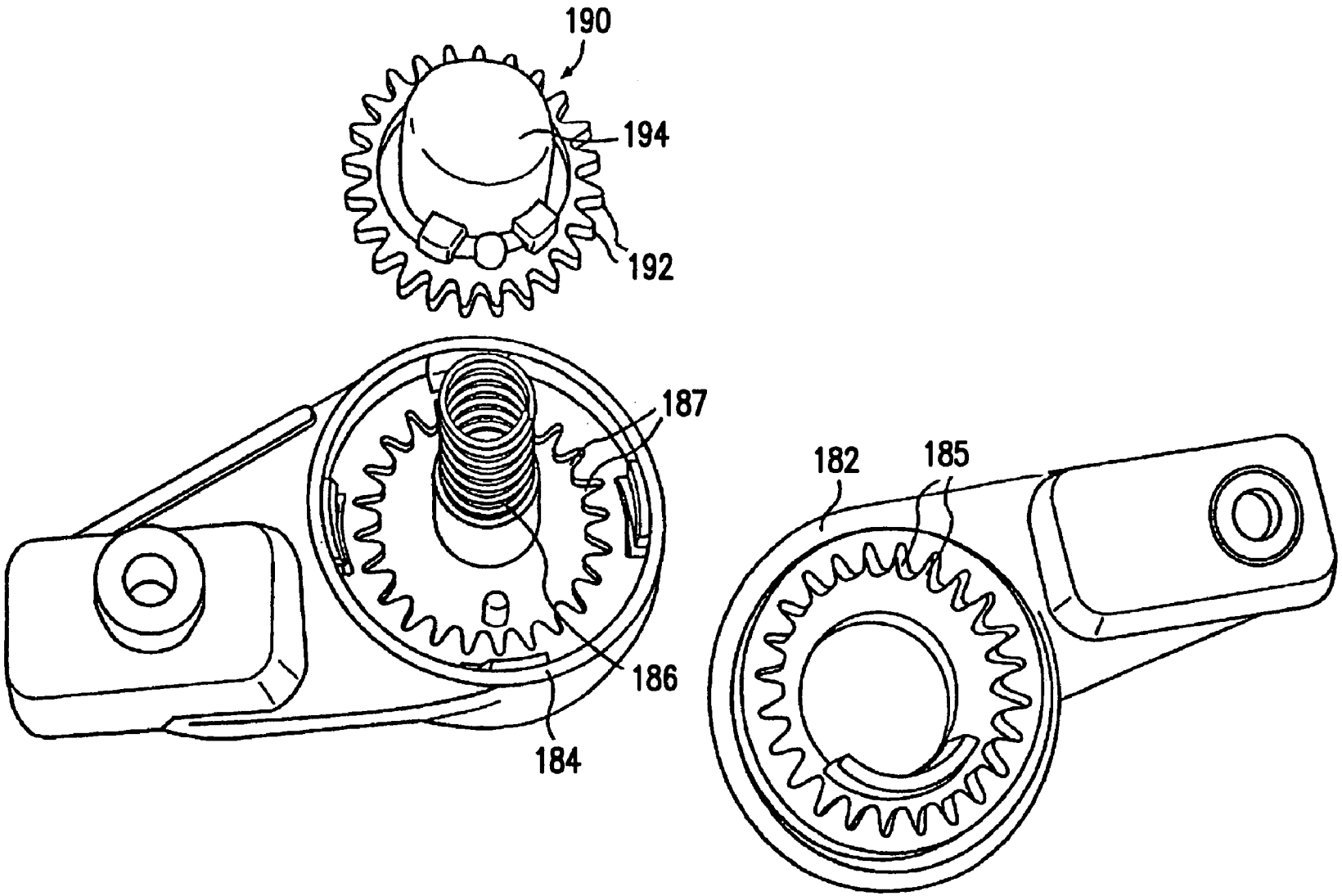

The mount 134 can have a pivot joint that can be used to pivot the support base 160 to a desired recline position or to a fold position relative to the hanger arms 130. FIGS. 6A-6C illustrate a pivot joint 180 that can be incorporated into the mount 134. The pivot joint comprises a bidirectional lock that includes two disc-like housings 182, 184. The first housing 182 is mounted to the hanger arm 130 at its second end 138 and the second housing 184 is mounted to the support base 160. A toothed gear arrangement is positioned between the housings 182, 184. As seen in FIG. 6C, the housings 182, 184 each have grooves 185, 187, to receive the teeth 192 of gear 190. The gear 190 can be keyed to stay in place in housing 184 at key 188. When a button 194 extending through housing 182 is depressed, the gear 190 compresses spring 186 and retracts fully in housing 182, allowing housing 184 to rotate in relation to housing 182. Once the rotation begins, the gear 190 is blocked from re-engaging housing 182 and relocking the pivot joint until its gear pattern realigns with the grooves 185 in housing 182. By varying the gear pattern, the pivot joint can engage at only specifically determined angles. In this regard, the pivot joint can control pivoting of the support base 160 to which it is attached. For example, the gear pattern can be varied to enable rotation of the support base 160 to adjust the recline position of the support base 160, as seen in FIG. 7. The gear pattern may be customized to provide one or more recline positions, such as a fully reclined position, an upright position, and any number of intermediate positions. The gear pattern can also be varied to enable rotation of the support base 160 between an in-use position, as seen in FIG. 1, and a folded position, as seen in FIG. 8.

Figure 12:
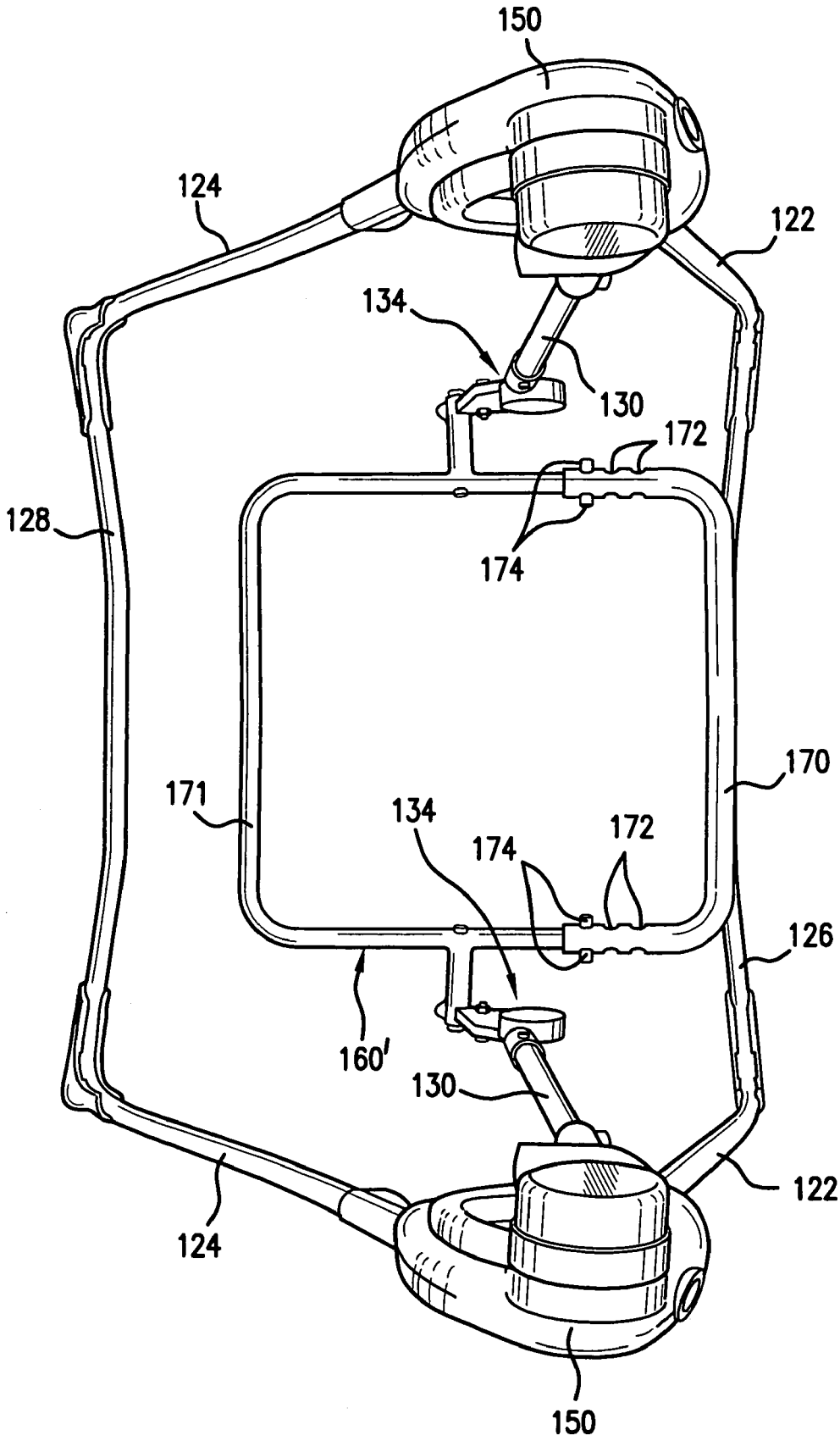
FIG. 12 is a top perspective view of a swing including a support base with telescoping sides.

FIG. 12 shows an alternative support base 160'. As shown in FIG. 12, the support base 160' can include a first frame member 170 and a separate second frame member 171. The first frame member 170 can be adjustable relative to the second frame member 171 to vary a length dimension of the support base 160'. In this manner, infant carriers of different sizes can be coupled to the support base 160'. For example, the second frame member 171 can telescope within the first frame member 170 to vary a length dimension of the support base 160'. Of course, the first frame member 170 can telescope within the second frame member 172 in an alternative embodiment. The first frame member 170 can include a plurality of apertures 172 spaced along the first frame member 171, and the second frame member 171 can include detents 174. The detents 174, when pushed in, allow the telescoping action by enabling the second frame member 171 to be slid within the first frame member 170. In this regard, a caregiver can choose the size of the support base 160' to match a particular infant carrier simply by choosing appropriate apertures 172 to receive detents 174.

Figure 10:
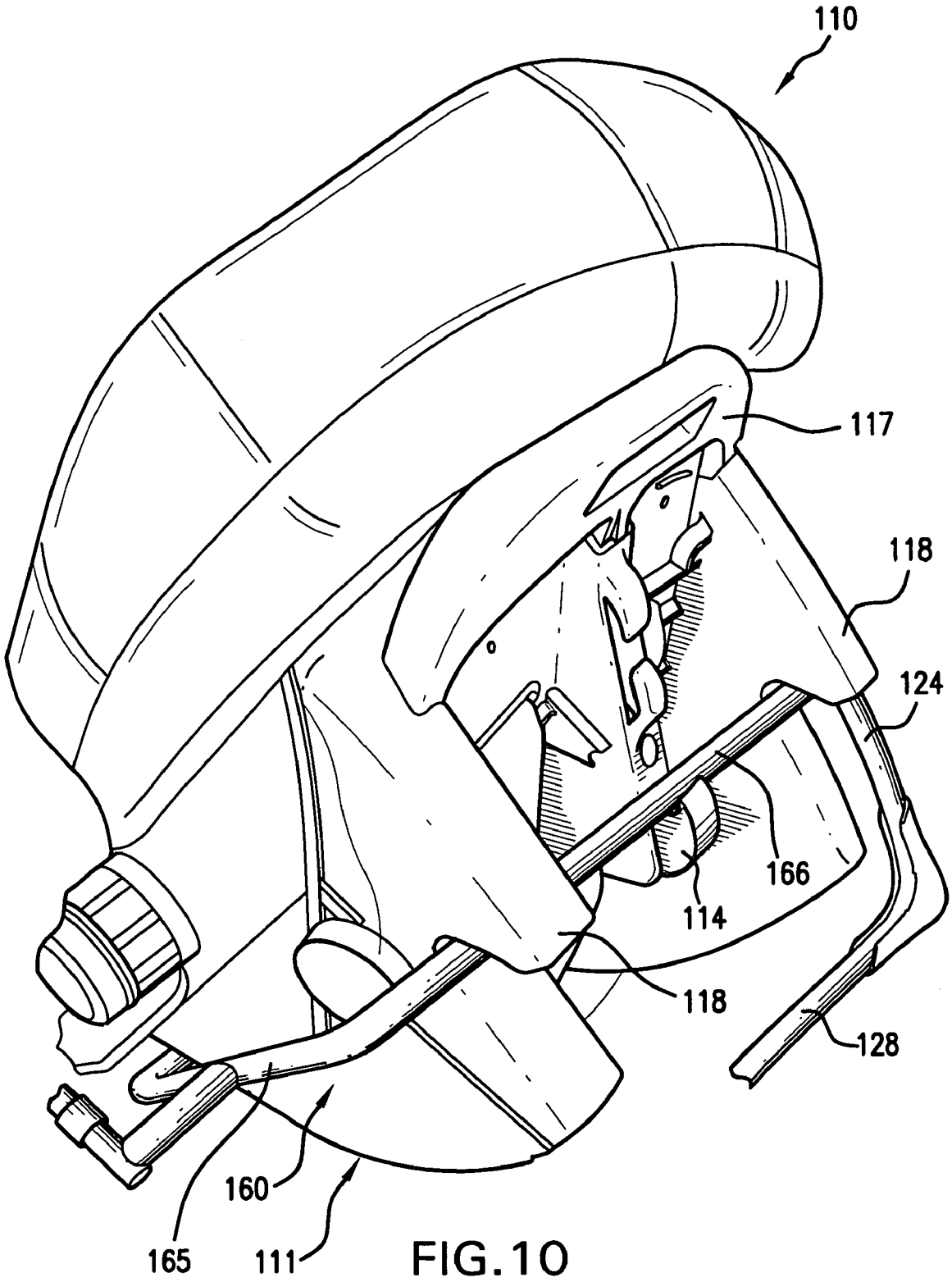
FIG. 10 is a detail rear perspective view of the swing of FIG. 1 showing a child carrier coupled to the support base.
Figure 11:
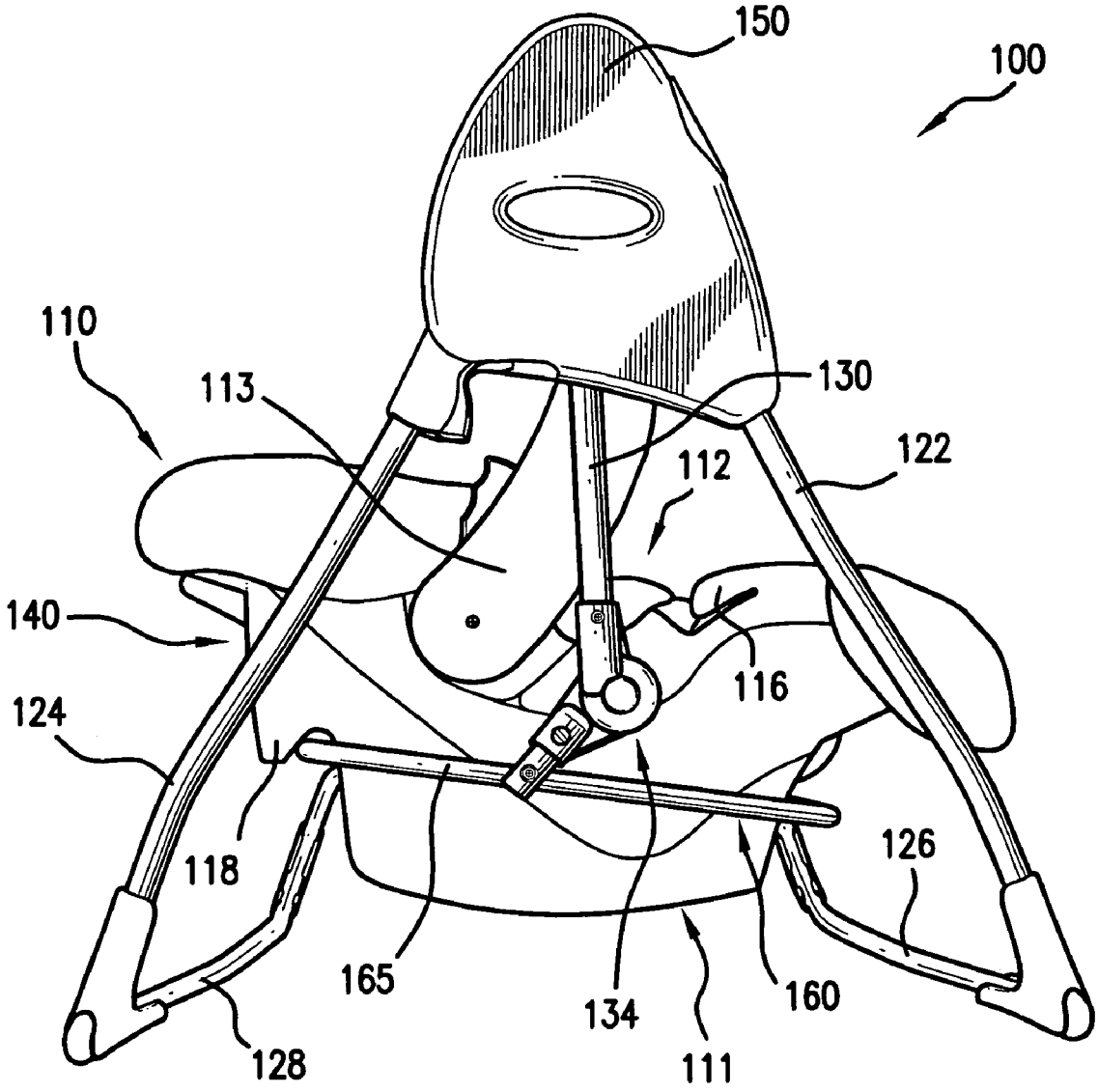
FIG. 11 is a side perspective view of the swing of FIG. 1 showing the child carrier coupled to the support base.

The child carrier 110, as shown in FIGS. 1, 10 and 11, includes a carrier shell 140 having a seat back 142, a seat bottom 144, and sidewalls 146 to define a child seating area 112. Soft goods can cover an upper surface of the carrier shell 140, as shown in FIG. 11, to provide a comfortable seating area 112 for the child. The carrier shell 140 also includes a pair of belt path guides 116 to define a belt pathway for a vehicle belt to secure the child carrier 110 to a vehicle seat. In the child carrier 110, an area between the sidewalls 146, in front of the seat back 142, and above the seat bottom 144 is free of obstruction, except for the soft goods covering the carrier shell 140 and the harness system that secures the child in the child seating area. For example, the child carrier 110 does not include a tray. The child carrier 110 also can include a carrying arm 113 that can be pivoted away from the area between the sidewalls 146, in front of the seat back 142, and above the seat bottom 144.

The child carrier 110 further includes a lower surface 111 contoured to be placed onto and secured to the support base 160 so that the support base 160 can hold the child carrier 110 stably. At the "head end" of the child carrier 110, the lower surface 111 can include an overhang portion 118, which can fit over the second frame member 166. At the "feet end" of the child carrier 110, the lower surface 111 can rest on the first frame member 164 of the support base 160.

As mentioned above, the child carrier 110 is removably coupled to the support base 160 and is configured to removably couple to a base of an infant car seat. The child carrier 110 includes a release handle 117 which both facilitates removal of the child carrier 110 from the support base 160 and facilitates removal of the child carrier 110 from the infant car seat base. A release latch 114 is positioned on the lower surface 111 of the child carrier 110 and can connect to the second (rear) frame member 166 of the support base 160. The release latch 114 has a hook shape that can capture and partially encircle the second frame member 166 of the support base 160, as shown in FIG. 10. The child carrier 110 can be removed from the support base 160 by actuation of the release latch 114 of the child carrier 110. In this regard, the handle 117 on the lower surface 111 of the child carrier 110, when pulled, actuates the release latch 114, as occurs in a conventional child carrier. The actuation pivots the release latch 114 away from the second frame member 166 and detaches the child carrier 110 from the support base 160. Upon removal of the child carrier 110 from the support base 160, the support base 160 remains coupled to the hanger arm 130, and the hanger arm 130 remains coupled to the frame 120, as shown in FIG. 2.

FIGS. 13-22 illustrate a second embodiment of a child swing 200. The child swing 200 includes a frame 220, first and second hanger arms 230 movably coupled to the frame 220, and a support base 260 coupled to the first and second hanger arms 230. The support base 260 is configured to receive a child carrier of an infant car seat.

The frame 220 is similar to frame 120. For example, the frame 220 generally includes first and second front legs 222, first and second rear legs 224, housings 250 to which the front and rear legs 222, 224 are coupled, a front cross member 226 extending between the front legs 222, and a rear cross member 228 extending between the rear legs 224. The housings 250 can have an outboard side 252 and an inboard side 254 facing the support base 260. The frame 220 can also have movable handles 256.

Figure 18:
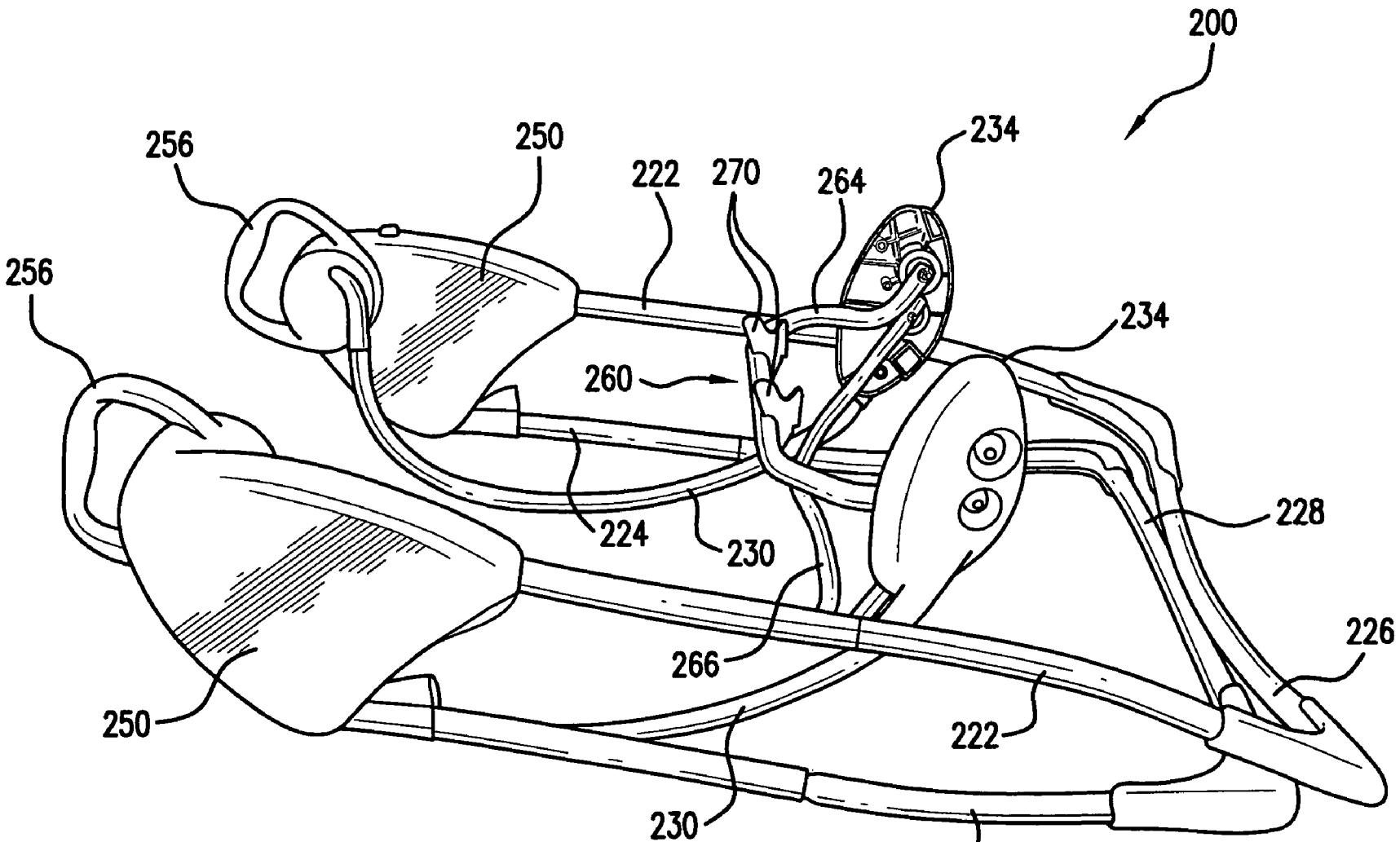
FIG. 18 is a side view of the swing of FIG. 13 showing the frame in a folded position.

The frame 220 can be an open top frame such that the when the child carrier 110 is coupled to the support base 260, an area above the child carrier 110 is free from obstruction from the frame 220. A child and child carrier 110 can be easily installed in or removed from the support base 260 by a user because of this open area. A device that can be attached to and removed from an open top, such as a mobile, toy bar or other similar device, does not change an open top swing to a closed top swing. Additionally, the frame 210 optionally can be configured to fold between an in-use configuration and a fold configuration, as can be seen in FIG. 18. Further, a variety of frames can be used with the support base 260 of the present invention.

The frame 220 can also include a motor 231 as shown in FIG. 13 to swing the hanger arms 230, support base 260 and the child carrier 110. The motor 231 is configured to swing the weight of the child and the weight of the child carrier.

The first and second hanger arms 230 of an embodiment of the swing 200 can be similar to the first and second hanger arms 130. A first end 236 of the hanger arms 230 attaches to the frame 220 at the inboard side 252 of the housing 250. The hanger arms 230 are movably coupled to the frame 220. For example, the hanger arms 230 can swing or pivot. A second end 238 of the hanger arms 230 attaches to the support base 260 at a mount 234. The mounts 234 connect the hanger arms 230 to the support base 260. Alternatively, a single hanger arm 230 can be used to suspend the support base 260.

The support base 260 comprises a first, front frame member 264 and a second, rear frame member 266 separate from the first frame member 164. The first and second frame members 264, 266 each connect to the mounts 234 of the hanger arms 230 and can pivot relative to those mounts 234. Fasteners 278 can be used to couple the first and second frame members 264, 266 to the mounts 234. In an alternative embodiment, the first frame member 264 and the second frame member 266 can be pivotally coupled together to pivot relative to each other. The support base 260 can be made of metal, or any other suitable material.

Figure 15:
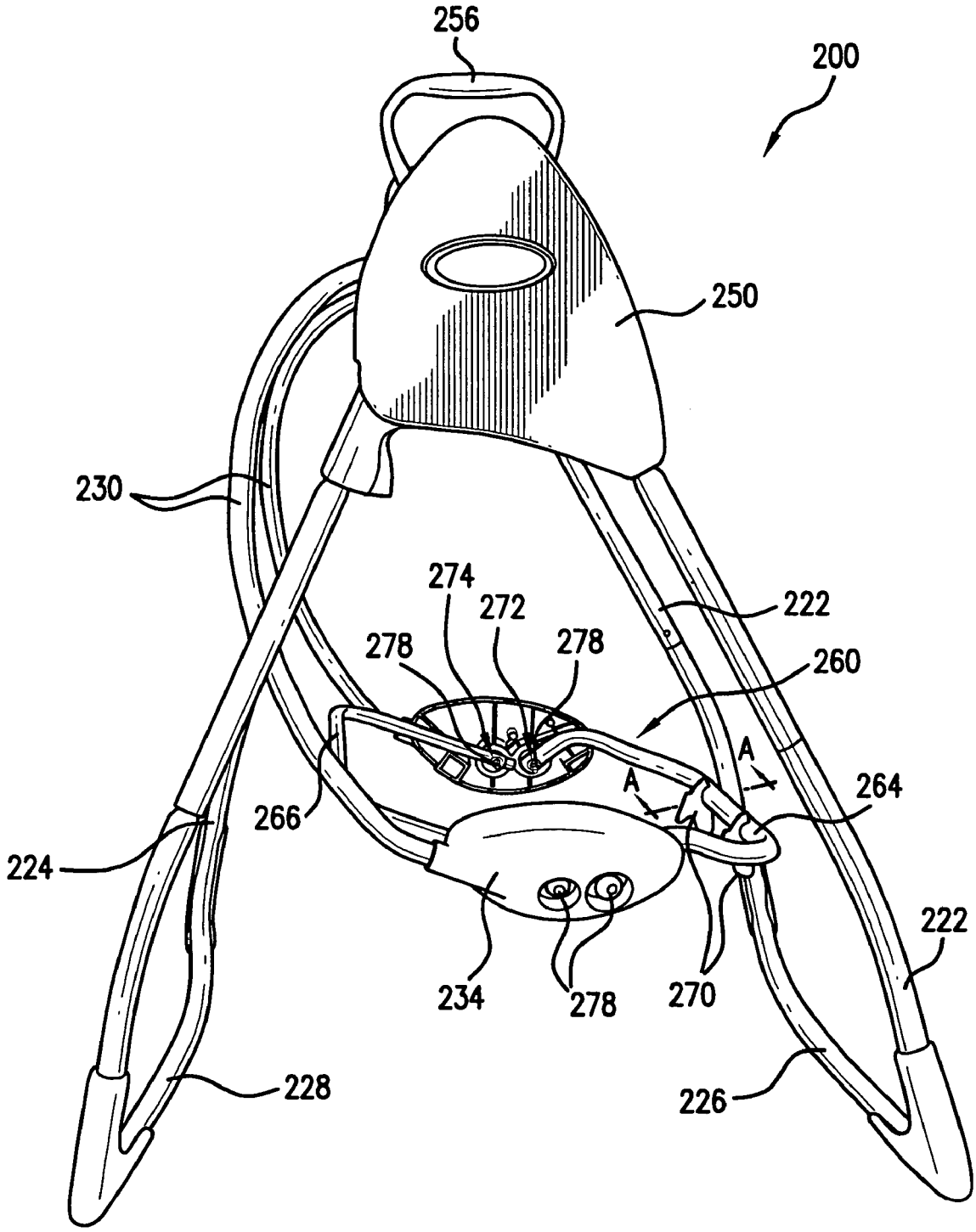
FIG. 15 is a side perspective view of the swing of FIG. 13.
Figure 16:
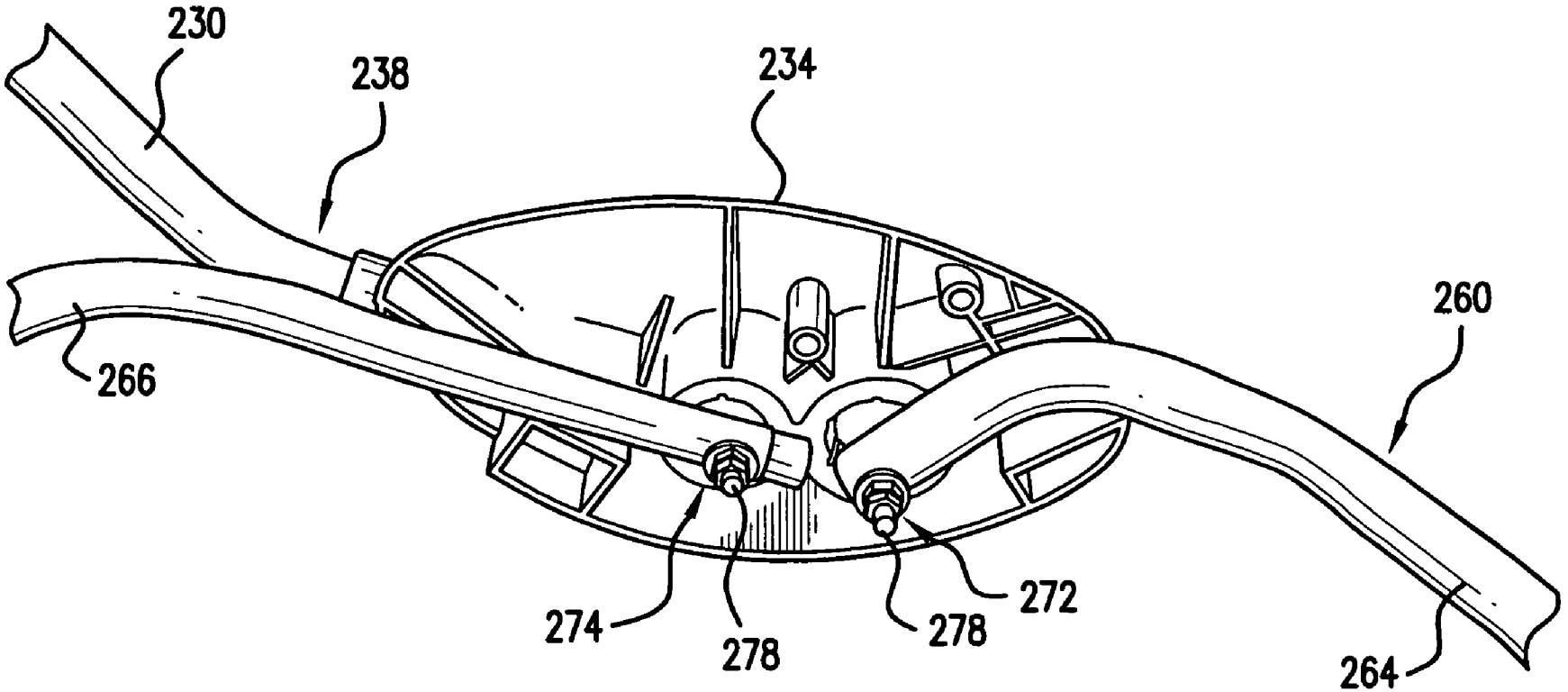
FIG. 16 is a detail perspective view of the swing of FIG. 13 showing the connection between the hanger arm and the support base.
Figure 17:
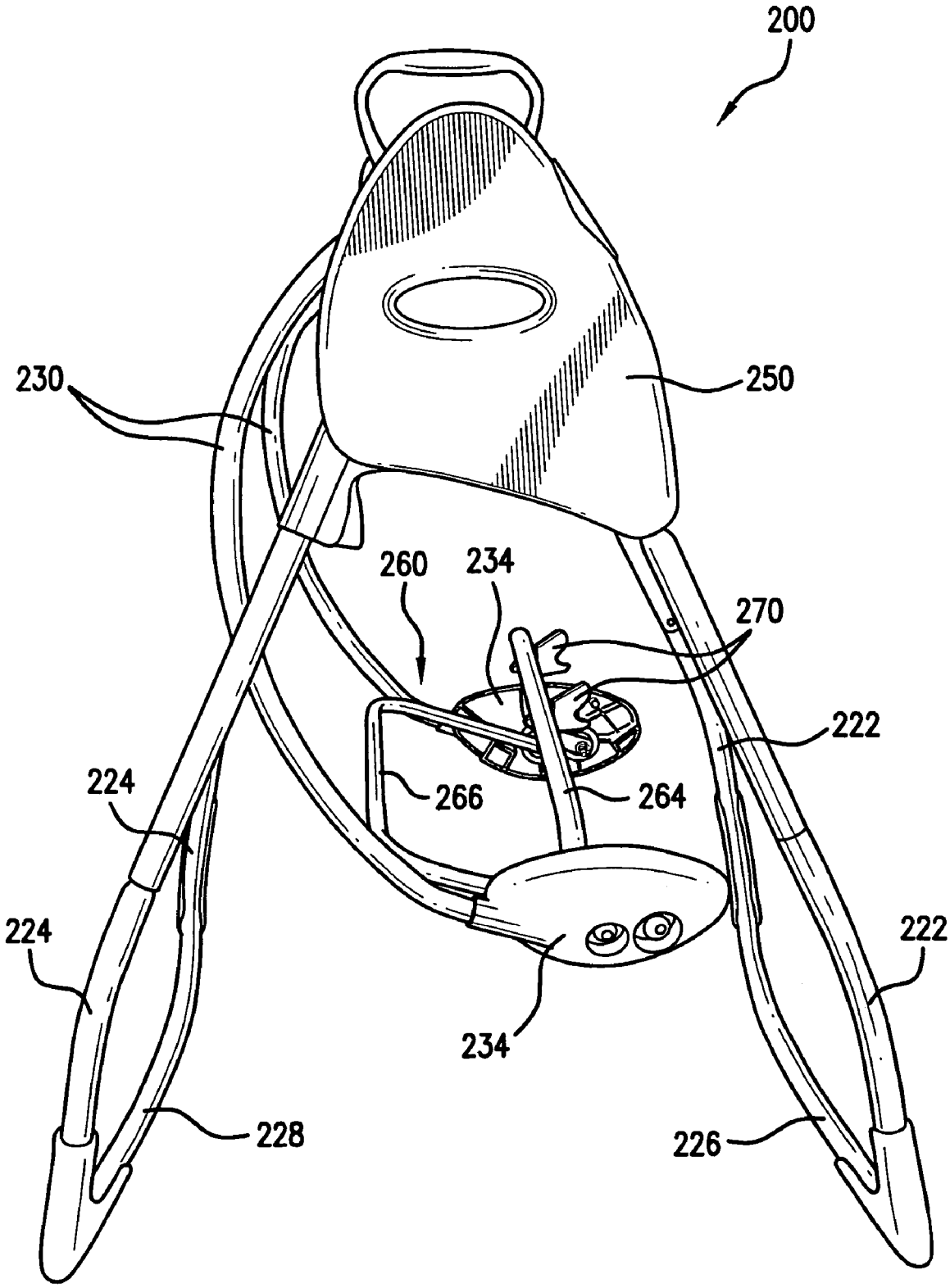
FIG. 17 is a side perspective view of the swing of FIG. 13 showing the support base in a folded position.

The first and second frame members 264, 266 of the support base 260 can be movably coupled to the hanger arms 230 to move between an in-use position and a fold position. An exemplary in-use position is shown in FIG. 15 and an exemplary fold position is shown in FIG. 17. To move the support base 260 to the fold position, the front frame member 264 pivots at a first pivot joint 272 on the mount 234. When the front frame member 264 pivots, the front frame member 264 moves backward toward the rear frame member 266. Likewise, the rear frame member 266 pivots at a second pivot joint 274 on the mount 234. When the rear frame member 266 pivots, the rear frame member 266 moves forward, toward the front frame member 264.

Figure 21:
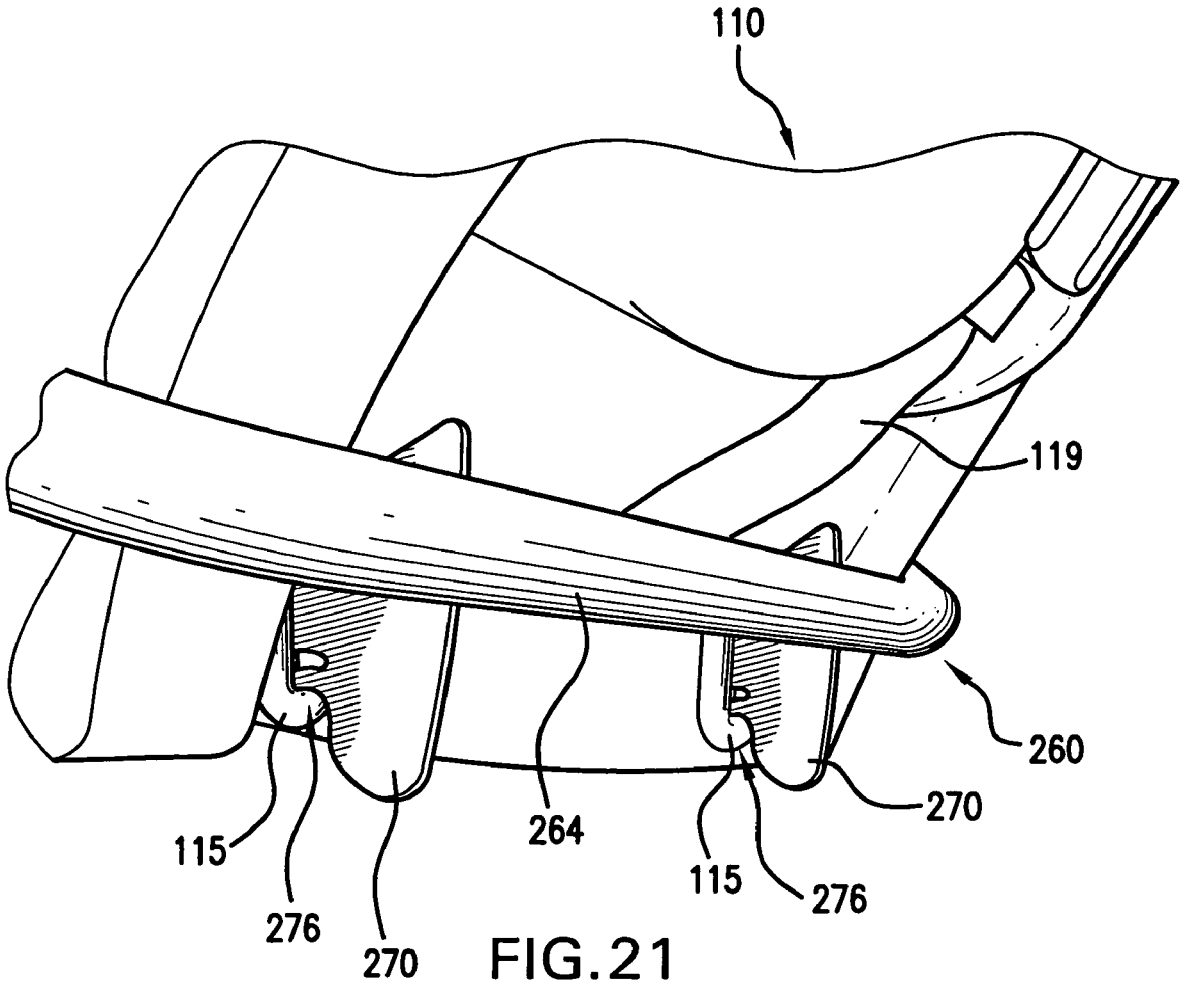
FIG. 21 is a detail perspective view of the swing of FIG. 13 showing the anchors of the child carrier attached to the hooks on the support base.
Figure 22:
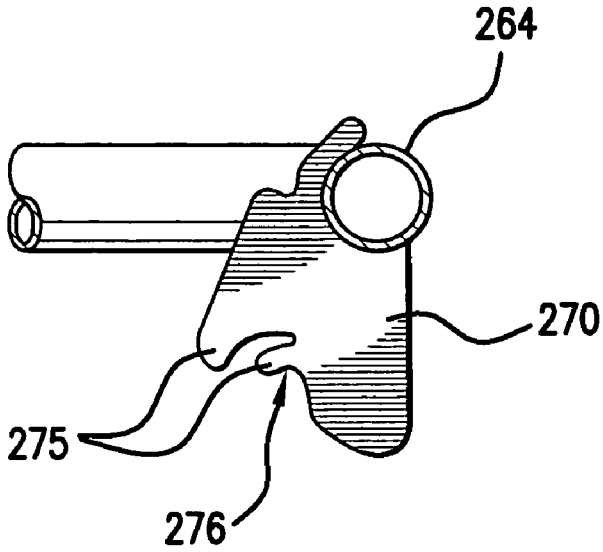
FIG. 22 is a cross-sectional view of the swing along line A-A of FIG. 15.

The support base 260 also includes at least one hook 270, and preferably two hooks 270, to releasably connect to anchors 115 of the child carrier 110 (described below). The hooks 270 are mounted to the front frame member 264. The profile of each hook 270 is configured to allow the anchor 115 of a child carrier 110 to fit under the hook 270 and connect to the front frame member 264 of the support base 260. The hook 270 includes protrusions 275. The anchor 115 can be received under the lowermost protrusion 275 in hook-receiving area 276, as shown in FIG. 21. The hook 270 is similar to a hook on a conventional infant car seat base, and the anchors 115 are present on conventional child carriers.

Figure 19:
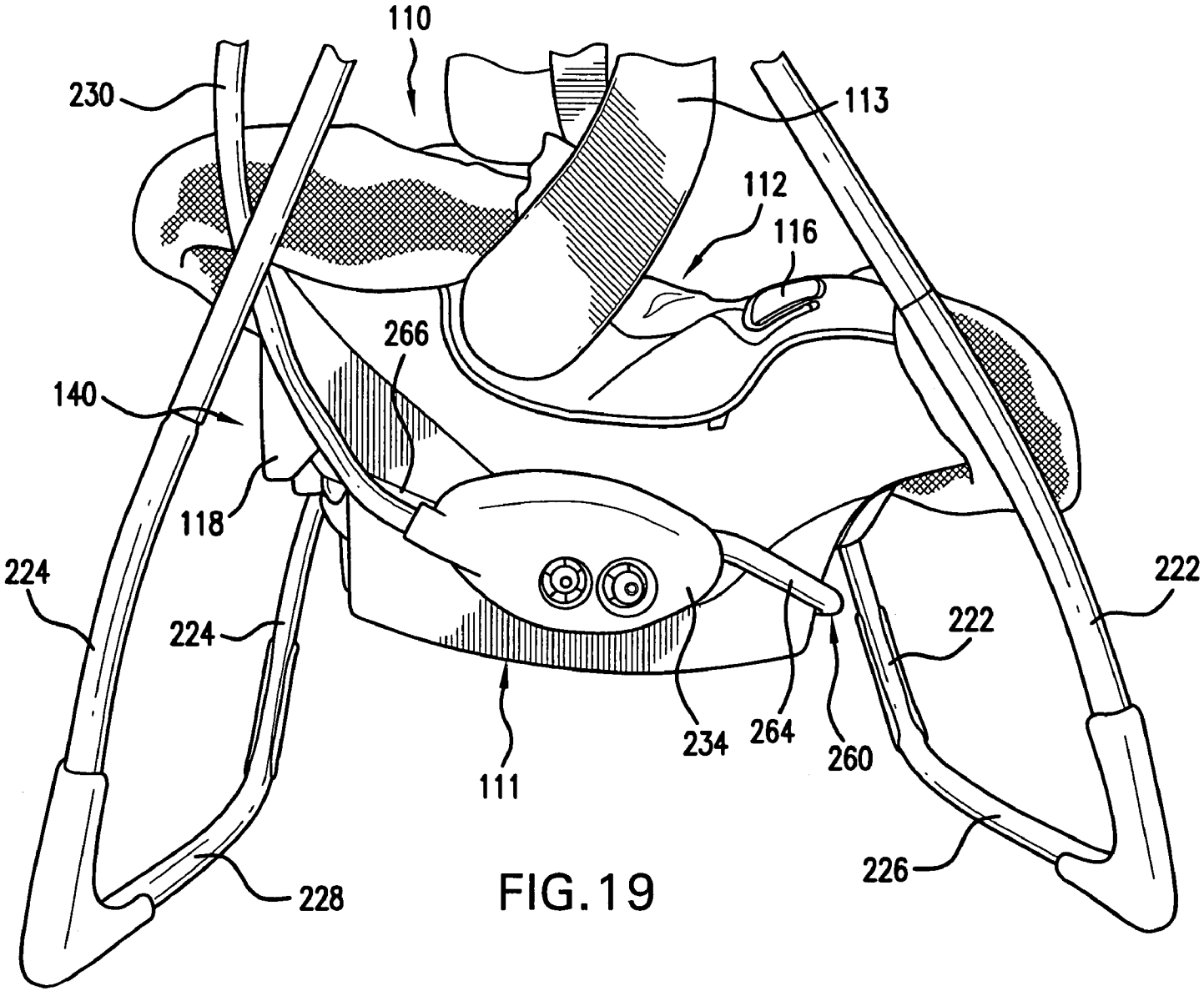
FIG. 19 is a detail side view of the swing of FIG. 13 with the child carrier coupled to the support base.
Figure 20:
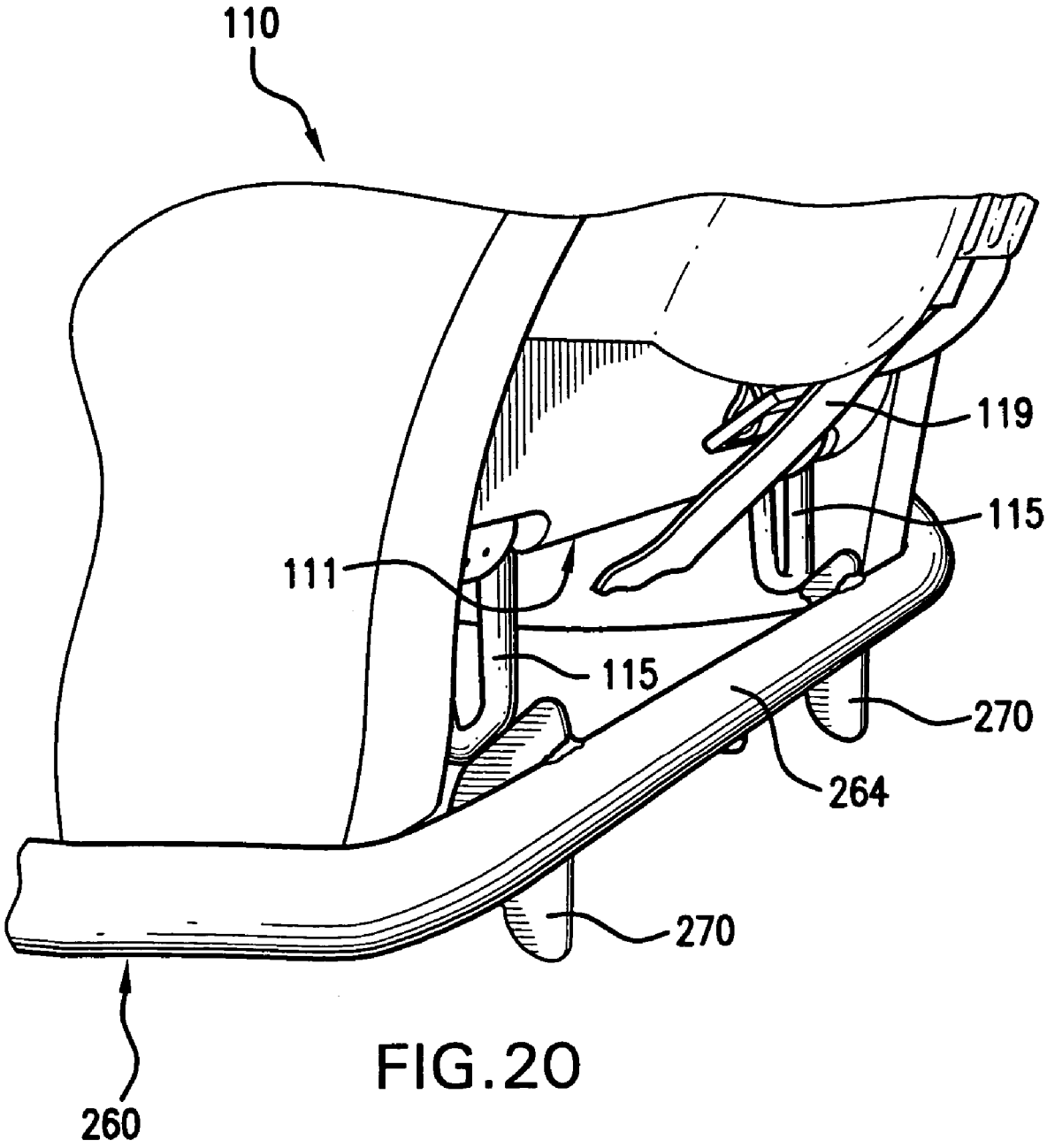
FIG. 20 is a detail perspective view of swing of FIG. 13 showing anchors of the child carrier above hooks on the support base.

The child carrier 110, as shown in FIGS. 19-21, includes a child seating area 112, a release latch and a handle (not shown). The release latch and handle are similar to that shown in FIG. 10 and function identically to release latch 114. The release latch 114 can releasably couple the child carrier 110 to the support base 260 at the rear frame member 266. The handle 117 facilitates removal of child carrier 110 from the support base 260, but also facilitates removal of the child carrier 110 from the infant car seat base. The child carrier 110 can also include a carrying arm 113. The child carrier 110 can removably couple to the support base 260 and the base of an infant car seat via its anchors 115 and release latch 114. The release latch 114 is positioned on the lower surface 111 of the child carrier 110 and can connect to the second (rear) frame member 166 of the support base 160. The release latch 114 has a hook shape that can capture and partially encircle the second frame member 166 of the support base 160, as shown in FIG. 10.

The child carrier 110, as shown in FIGS. 1, 10, 19 and 20, includes a carrier shell 140 having a seat back 142, a seat bottom 144, and sidewalls 146 to define a child seating area 112. Soft goods can cover an upper surface of the carrier shell 140, as shown in FIG. 11, to provide a comfortable seating area 112 for the child. The carrier shell 140 also includes a pair of belt path guides 116 to define a belt pathway for a vehicle belt to secure the child carrier 110 to a vehicle seat. In the child carrier 110, an area between the sidewalls 146, in front of the seat back 142, and above the seat bottom 144 is free of obstruction, except for the soft goods covering the carrier shell 140 and the harness system that secures the child in the child seating area. For example, the child carrier 110 does not include a tray. The child carrier 110 also can include a carrying arm 113 that can be pivoted away from the area between the sidewalls 146, in front of the seat back 142, and above the seat bottom 144.

The child carrier 110 further includes a lower surface 111 contoured to be placed onto and secured to the support base 260 so that the support base 260 can hold the child carrier 110 stably. At the "head end" of the child carrier 110, the lower surface 111 can include an overhang portion 118, which can fit over the second frame member 266. At the "feet end" of the child carrier 110, the lower surface 111 can rest on the first frame member 264 of the support base 260.

The child carrier 110 includes a pair of anchors 115. The anchors 115 are positioned at a lower surface 111 of the child carrier 110 at the "foot end" of the child carrier 110. The anchors 115, shown in FIG. 20, are generally U-shaped extensions. The anchors 115 fit to hooks 270, as shown in FIG. 21. The child carrier 110 can be removed from the support base 260 by actuation of the release latch of the child carrier 110. Upon pulling the handle 117 (described above) at the "head" end of the child carrier 110, the anchors 115 rotate away from the hooks 270, as occurs in a conventional car seat. The handle 117 is connected to the anchors 115 by a cable (not shown), and pulling on the handle 117 detaches the child carrier 110 from the support base 260. Upon pulling the handle 117, the release latch 114 lowers and releases the support base 260 and the anchors 115 simultaneously rotate away from the hooks 270, thus releasing the child carrier 110 from the support base 260. The child carrier 110 can be removed from the support base 260 by actuation of the release latch 114 of the child carrier 110. The handle 117, when pulled, actuates the release latch 114, as occurs in a conventional child carrier. The actuation pivots the release latch 114 away from the second frame member 266 and detaches the child carrier 110 from the support base 260. Upon removal of the child carrier 110 from the support base 260, the support base 260 remains coupled to the hanger arms 230, and the hanger arms 230 remains coupled to the frame 220.

Additionally, the swing 100 could support the child carrier 110 by a hook or linkage coupled to the housing 150 on the frame 120. The hook or linkage is coupled to the carrying arm 113 of the child carrier 110. Further, the child carrier 110 can be received by a glider platform coupled to the hanger arms 130 on the swing 100. The glider platform is configured to allow the child carrier 110 to move forward in backward in a gliding motion. The glider platform does not have a rocking motion.

The embodiments described above have been set forth herein for the purpose of illustration. This description, however, should not be deemed to be a limitation on the scope of the invention. Various modifications, adaptations, and alternatives may occur to one skilled in the art without departing from the claimed inventive concept. The scope and spirit of the invention are indicated by the following claims.

What is claimed is:

1. A child swing, comprising:

a frame having an open top and foldable between an in-use configuration and a fold configuration;

at least one hanger arm movably coupled to the frame;

a child carrier of an infant car seat, the child carrier having a lower surface, a carrying arm for carrying a child in the child carrier when used independently of the frame, and a coupling structure on the tower surface; and a support base having at least one attachment location configured to receive and removably couple the child carrier at the coupling structure, wherein one of the coupling structure and the at least one attachment location includes an indentation contoured to receive the other of the coupling structure and the at least one attachment location, such that, when the child carrier is coupled to the support base, an area above the child carrier is free of obstruction from the frame, the support base movably coupled to the at least one hanger arm to move between an in-use position and a fold position, wherein, upon removal of the child carrier from the support base, the support base remains coupled to the at least one hanger arm, and the at least one hanger arm remains coupled to the frame.

2. The child swing according to claim 1, further comprising a first pivot joint coupling the support base to the at least one hanger arm.

3. The child swing according to claim 1, wherein the support base comprises a first frame member and a second frame member, and the hanger arm includes a mount to which the first and second frame members connect.

4. The child swing according to claim 1, wherein the support base includes a first frame member and a second frame member opposite the first frame member.

5. The child swing according to claim 1, wherein the support base includes a first frame member and a second separate frame member.

6. The child swing according to claim 5, wherein the first frame member is adjustable relative to the second frame member.

7. The child swing according to claim 6, wherein one of the first and second frame members telescopes within the other of the first and second frame members to vary a length dimension of the support base.

8. The child swing according to claim 6, wherein the first frame member is pivotally coupled to the second frame member.

9. A child swing, comprising:

a frame foldable between an in-use configuration and a fold configuration;

at least one hanger arm movably coupled to the frame; and a support base configured to receive a child carrier of an infant car seat, the support base movably coupled to the at least one hanger arm to move between an in-use position and a fold position, wherein upon removal of the child carrier from the support base the support base remains coupled to the at least one hanger arm, and the at least one hanger arm remains coupled to the frame, and wherein the support base is movably coupled to the at least one hanger arm to move between a first recline position and a second recline position relative to the at least one hanger arm.

10. A child swing, comprising:

a frame having an open top;

at least one hanger arm movably coupled to the frame;

a motor coupled to the at least one hanger arm; and a support base movably coupled to the at least one hanger arm to move between an in-use position and a fold position and having at least one attachment location;

a child carrier having a carrying arm for carrying a child in the child carrier when used independently of the frame;

wherein the child carrier includes a lower surface having at least one coupling structure configured to removably couple to the at least one attachment location on the support base, wherein one of the coupling structure and the at least one attachment location includes an indentation contoured to receive the other of the coupling structure and the at least one attachment location, the child carrier further including a release latch to capture and partially encircle part of the support base when the child carrier is coupled to the support base, and a release handle operably coupled to the release latch, such that, when the release handle is pulled the release latch pivots out of engagement with the support base to release the child carrier from the support base, such that, when the child carrier is coupled to the support base, an area above the child carrier is free of obstruction from the frame.

11. The child swing according to claim 10, wherein the child carrier includes a carrier shell having a seat back, a seat bottom, and sidewalls to define a child seating area, and an area between the sidewalls and in front of the seat back and the seat bottom is free of obstruction.

12. The child swing according to claim 10, wherein the child carrier includes a carrier shell having a pair of belt path guides to define a belt pathway for a vehicle belt.

13. The child swing according to claim 10, wherein the at least one hanger arm comprises first and second hanger arms, and the support base is coupled to the first and second hanger arms.

14. The child swing according to claim 13, wherein the support base is movably coupled to the hanger arms to move between a first recline position and a second recline position relative to the hanger arm.

15. The child swing according to claim 10, wherein the support base comprises a frame member formed in a continuous, rectangular shape.

16. The child swing according to claim 10, wherein the support base includes a first frame member and a second frame member opposite the first frame member.

17. The child swing according to claim 10, wherein the support base includes a first frame member and a second separate frame member.

18. The child swing according to claim 17, wherein the first frame member is adjustable relative to the second frame member.

19. The child swing according to claim 18, wherein the first frame member is pivotally coupled to the second frame member.

20. The child swing according to claim 1, wherein one of the first and second frame members telescopes within the other of the first and second frame members to vary a length dimension of the support base.

21. The child swing according to claim 10, wherein the frame includes a front leg and a back leg.

22. A child swing, comprising:

a frame foldable between an in-use configuration and a fold configuration;

at least one hanger arm movably coupled to the frame;

a child seat having a rigid shell with a seat back, a seat bottom, and sidewalls, the child seat configured to for use independently of the frame as a child carrier;

a support base configured to receive the child seat, the support base movably coupled to the at least one hanger arm to move between an in-use position and a fold position;

a release latch on the child seat configured to capture and partially encircle a part of the support base when the child seat is coupled to the support base; and a release handle operably coupled to the release latch, such that, when the release handle is pulled the release latch pivots out of engagement with the support base to release the child seat from the support base, wherein upon removal of the child seat from the support base the support base remains coupled to the at least one hanger arm, and the at least one hanger arm remains coupled to the frame.

* * * * *